US011472012B2

(12) United States Patent
Ootsuka

(10) Patent No.: US 11,472,012 B2
(45) Date of Patent: Oct. 18, 2022

(54) DRIVER

(71) Applicant: KOKI HOLDINGS CO., LTD., Tokyo (JP)

(72) Inventor: Kazuhiro Ootsuka, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 132 days.

(21) Appl. No.: 16/968,472

(22) PCT Filed: Jan. 25, 2019

(86) PCT No.: PCT/JP2019/002479
§ 371 (c)(1),
(2) Date: Aug. 7, 2020

(87) PCT Pub. No.: WO2019/159653
PCT Pub. Date: Aug. 22, 2019

(65) Prior Publication Data

US 2020/0398411 A1 Dec. 24, 2020

(30) Foreign Application Priority Data

Feb. 19, 2018 (JP) ..... JP2018-027010

(51) Int. Cl.
*B25C 1/04* (2006.01)
*B25C 1/00* (2006.01)

(52) U.S. Cl.
CPC ..... *B25C 1/047* (2013.01); *B25C 1/008* (2013.01)

(58) Field of Classification Search
CPC ..... B25C 1/043; B25C 1/047; B25C 1/008; B25C 1/04; B25C 1/06
See application file for complete search history.

(56) References Cited

U.S. PATENT DOCUMENTS 9,238,298 B2 * 1/2016 Wu ..... B25C 1/06
10,569,402 B2 * 2/2020 Iijima ..... B25C 1/008
(Continued)

FOREIGN PATENT DOCUMENTS

JP 2014-046424 A 3/2014
JP 2016-179526 A 10/2016
WO 2017/115593 A1 7/2017

OTHER PUBLICATIONS

International Search Report issued in corresponding International Patent Application No. PCT/JP2019/002479, dated Mar. 19, 2019, with English translation.

*Primary Examiner* — Anna K Kinsaul
*Assistant Examiner* — Veronica Martin
(74) *Attorney, Agent, or Firm* — McDermott Will & Emery LLP

(57) ABSTRACT

A driver includes: a pressure chamber and a striking portion actuated in a direction of striking a fastener when compressed gas is supplied to the pressure chamber, and can select a single firing and a continuous firing; a switching mechanism having a first actuated state to actuate the striking portion in the direction when the single firing is selected and a second actuated state to block the striking portion from being actuated in the direction when the continuous firing is selected; and a control unit configured to switch the switching mechanism from the first actuated state to the second actuated state when a predetermined time elapses in a state where the continuous firing is selected and the switching mechanism is in the first actuated state. The control unit stops the power supply to the switching mechanism for at least part of a period of time when the predetermined time elapses.

13 Claims, 34 Drawing Sheets

(56) References Cited

U.S. PATENT DOCUMENTS

| | | | | |
|---|---|---|---|---|
| 2014/0263535 | A1* | 9/2014 | Rajani | B25C 1/06 173/1 |
| 2018/0117748 | A1 | 5/2018 | Ishikawa et al. | |
| 2019/0022842 | A1 | 1/2019 | Oouchi | |

* cited by examiner

DRIVER

CROSS REFERENCE TO RELATED APPLICATIONS

This application is the U.S. National Phase under 35 U.S.C. § 371 of International Patent Application No. PCT/JP2019/002479, filed on Jan. 25, 2019, which claims the benefits of Japanese Patent Application No. 2018-027010, filed on Feb. 19, 2018 the entire contents of which are hereby incorporated by reference.

TECHNICAL FIELD

The present invention relates to a driver having a pressure chamber and a striking portion that is actuated in a direction of striking a fastener when compressed gas is supplied to the pressure chamber.

BACKGROUND ART

A driver configured to drive a fastener to a workpiece has been known. The driver described in Patent Document 1 has a housing, a pressure accumulation chamber, a pressure chamber, a striking portion, a push lever, a cylinder, a trigger, a trigger valve, an ejection portion, a magazine, and a delay valve as a switching mechanism. The pressure accumulation chamber is provided in the housing, and the pressure accumulation chamber stores compressed air. The pressure chamber and the striking portion are provided in the housing, and the striking portion is provided so as to be actuated in the housing. The cylinder is provided so as to be actuated in the housing, and the cylinder connects and disconnects the pressure chamber and the pressure accumulation chamber. The trigger is rotatably attached to the housing. The push lever is provided so as to be actuated on the housing. The ejection portion is fixed to the housing, and the ejection portion has an ejection path. The magazine stores fasteners and the magazine supplies the fasteners to the ejection path.

In the driver described in Patent Document 1, the cylinder disconnects the pressure accumulation chamber and the pressure chamber unless at least one of the conditions that an operation force is applied to the trigger and an operation force is applied to the push lever is satisfied. The compressed air of the pressure accumulation chamber is not supplied to the pressure chamber, and the striking portion is stopped at the top dead center. Namely, the striking portion is not actuated in the direction of striking the fastener.

In the driver described in Patent Document 1, the trigger valve is actuated and the cylinder is actuated to connect the pressure accumulation chamber and the pressure chamber when both of the conditions that the operation force is applied to the trigger and the operation force is applied to the push lever are satisfied. The compressed air of the pressure accumulation chamber is supplied to the pressure chamber, and the striking portion is actuated in the direction of striking the fastener.

The worker can perform single firing and continuous firing with use of the driver. The single firing is a usage mode in which the worker applies an operation force to the push lever and then applies an operation force to the trigger, thereby actuating the striking portion.

The continuous firing is a usage mode in which the worker applies an operation force to the trigger and the push lever regardless of the operation order of the trigger and the push lever, thereby actuating the striking portion.

In the driver described in Patent Document 1, for a predetermined time from the time when the operation force is applied to the trigger in order to perform the continuous firing, the delay valve connects the passage to supply the compressed gas of the pressure accumulation chamber to the pressure chamber. Therefore, if the operation force is applied to the push lever within the predetermined time from the time when the operation force is applied to the trigger in order to perform the continuous firing, compressed air is supplied to the pressure chamber, and the striking portion is actuated in the direction of striking the fastener.

On the other hand, when the predetermined time has elapsed from the time when the operation force is applied to the trigger in order to perform the continuous firing, the delay valve disconnects the passage to supply the compressed gas of the pressure accumulation chamber to the pressure chamber. Therefore, the compressed air is not supplied to the pressure chamber even if the operation force is applied to the push lever after the predetermined time has elapsed from the time when the operation force is applied to the trigger in order to perform the continuous firing. Namely, the striking portion is not actuated in the direction of striking the fastener. The delay valve described in Patent Document 1 is actuated by compressed gas.

RELATED ART DOCUMENTS

Patent Documents

Patent Document 1: International Patent Application Publication No. 2017-115593

SUMMARY OF THE INVENTION

Problem to be Solved by the Invention

The inventor of this application has recognized a problem that power consumption increases if a switching mechanism that switches from a state in which continuous firing is possible to a state in which continuous firing is not possible is configured to be actuated by electric power.

An object of the present invention is to provide a driver capable of suppressing an increase in electric power consumed for actuating the switching mechanism.

Means for Solving the Problems

A driver according to an embodiment includes: a pressure chamber; a striking portion actuated in a direction of striking a fastener when compressed gas is supplied to the pressure chamber; and a first operation member and a second operation member configured to control the striking of the fastener, the driver can select a single firing in which the striking portion is actuated in the direction of striking the fastener when an operation force is applied to the second operation member and then an operation force is applied to the first operation member and a continuous firing in which the striking portion is actuated in the direction of striking the fastener when the operation force is applied to the first operation member and the second operation member regardless of an order of applying the operation force to the first operation member and the second operation member, the driver further includes: a switching mechanism actuated when power is supplied and having a first control state in which the striking portion can be actuated in the direction of striking the fastener when the single firing is selected and a second control state in which the striking portion is blocked from being actuated in the direction of striking the fastener when the continuous firing is selected; and a control unit configured to switch the switching mechanism from the first control state to the second control state when a predetermined time elapses in a state where the continuous firing is selected and the switching mechanism is in the first control state, and the control unit stops the power supply to the switching mechanism for at least part of a period of time when the predetermined time elapses.

A driver according to another embodiment includes: a pressure chamber; a striking portion actuated in a direction of striking a fastener when compressed gas is supplied to the pressure chamber; and a first operation member and a second operation member configured to control the striking of the fastener, the driver can select a single firing in which the striking portion is actuated in the direction of striking the fastener when an operation force is applied to the second operation member and then an operation force is applied to the first operation member and a continuous firing in which the striking portion is actuated in the direction of striking the fastener when the operation force is applied to the first operation member and the second operation member regardless of an order of applying the operation force to the first operation member and the second operation member, the driver further includes: a switching mechanism actuated when power is supplied and having a first control state in which the striking portion can be actuated in the direction of striking the fastener when the single firing is selected and a second control state in which the striking portion is blocked from being actuated in the direction of striking the fastener when the continuous firing is selected; and a control unit configured to control the supply and stop of the power to the switching mechanism, and the control unit performs a first control in which, when the continuous firing is selected, power is supplied to the switching mechanism to change the switching mechanism from the second control state to the first control state and then the power supply to the switching mechanism is stopped and a second control in which, when a predetermined time elapses in a state where the continuous firing is selected and the switching mechanism is in the first control state, power is supplied to the switching mechanism to change the switching mechanism from the first control state to the second control state and then the power supply to the switching mechanism is stopped.

Effects of the Invention

A driver according to one embodiment can suppress the increase in electric power consumed for actuating the switching mechanism.

DETAILED DESCRIPTION OF PREFERRED EMBODIMENTS

Figure 1:
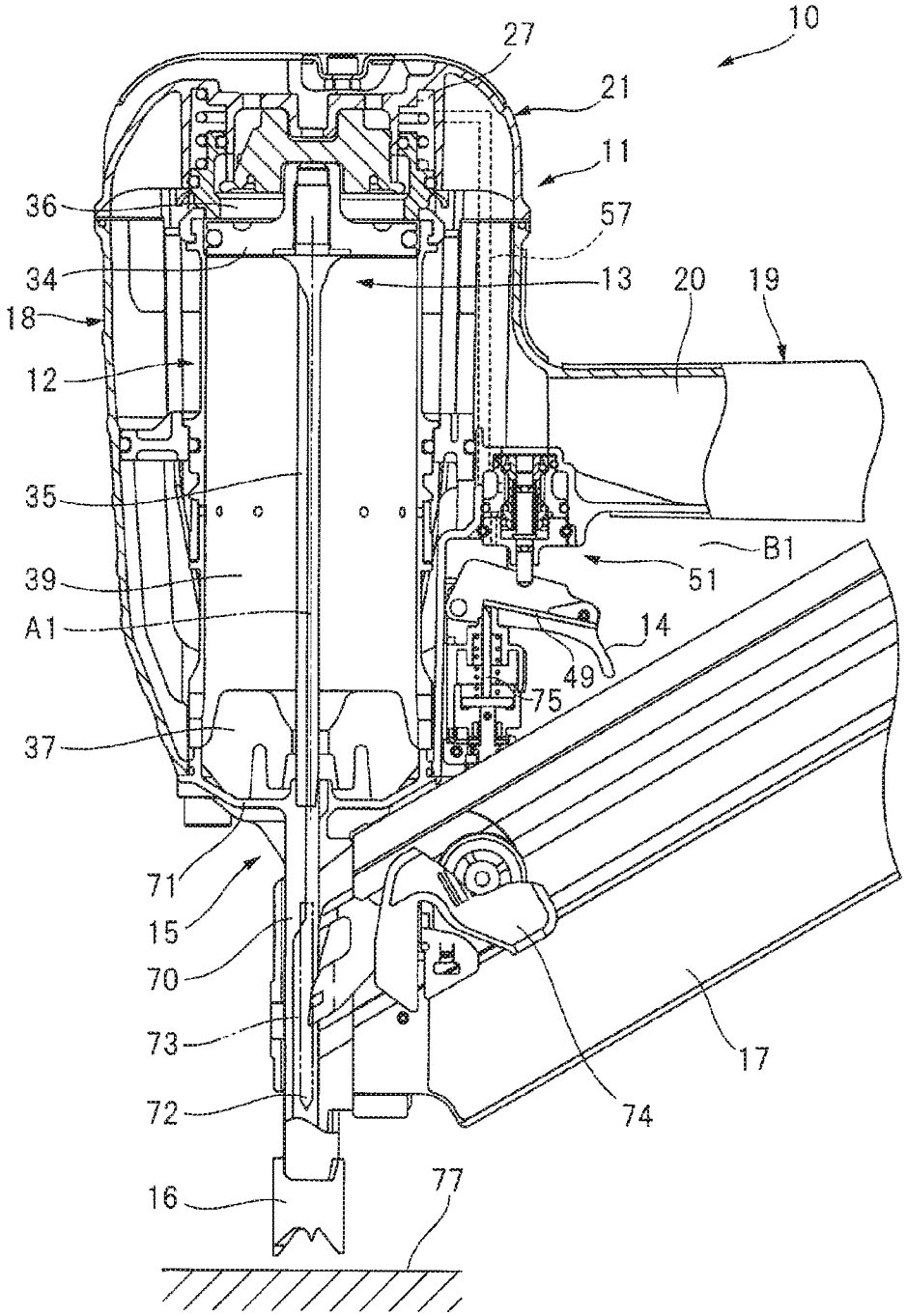
FIG. 1 is a longitudinal cross-sectional view showing a driver according to the first embodiment.

Next, some representative drivers among the drivers according to the embodiments included in the present invention will be described with reference to the drawings.

First Embodiment

A driver according to the first embodiment will be described with reference to FIGS. 1 and 2. The driver 10 includes a main body 11, a cylinder 12, a striking portion 13, a trigger 14, an ejection portion 15, and a push lever 16. Also, a magazine 17 is attached to the driver 10. The main body 11 has a tubular body portion 18, a head cover 21 fixed to the body portion 18, and a handle 19 connected to the body portion 18. The handle 19 projects from an outer surface of the body portion 18.

Figure 3A:
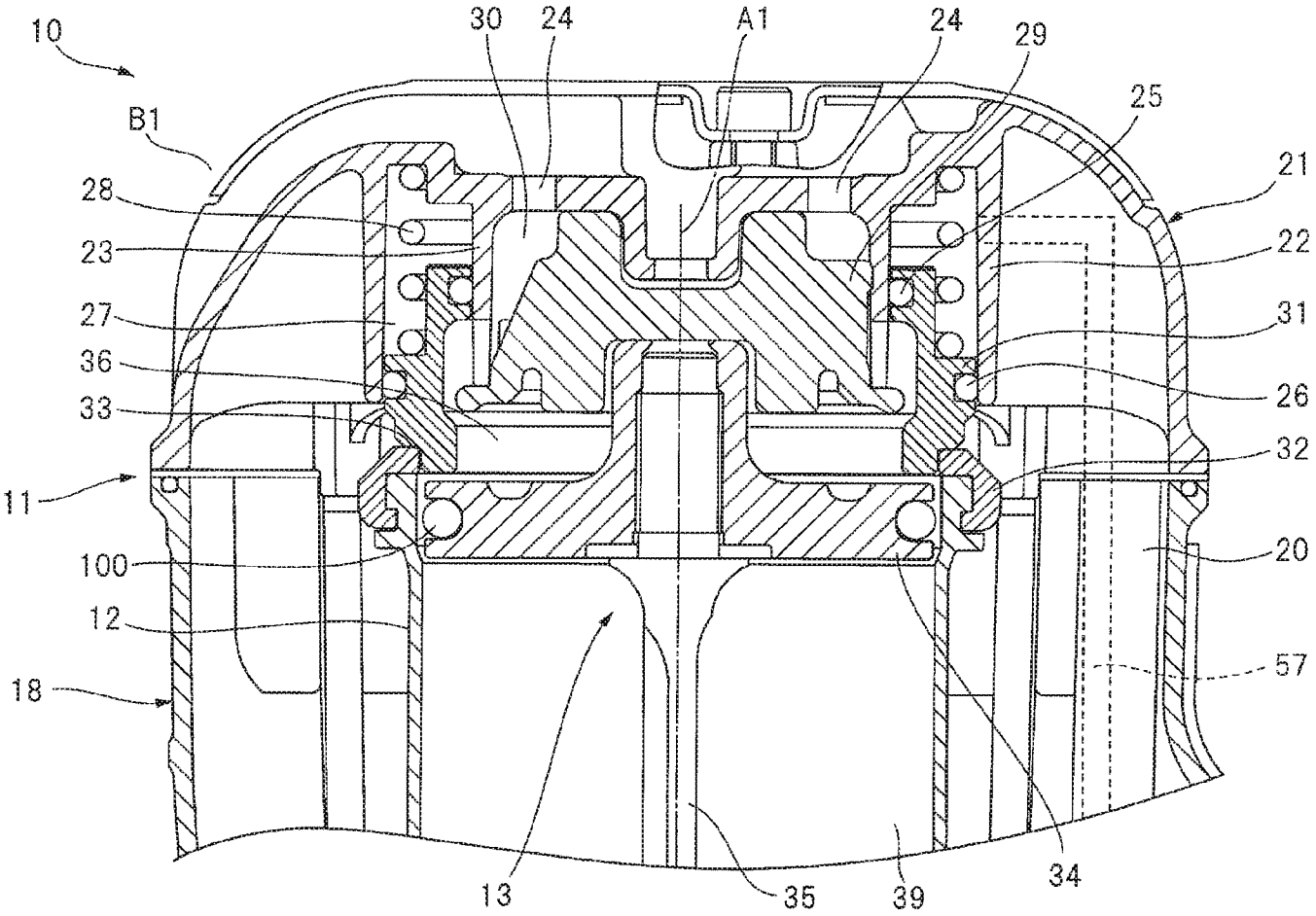
FIG. 3A is a partial cross-sectional view of the driver of FIG. 1, showing the state where a head valve closes a port.
Figure 3B:
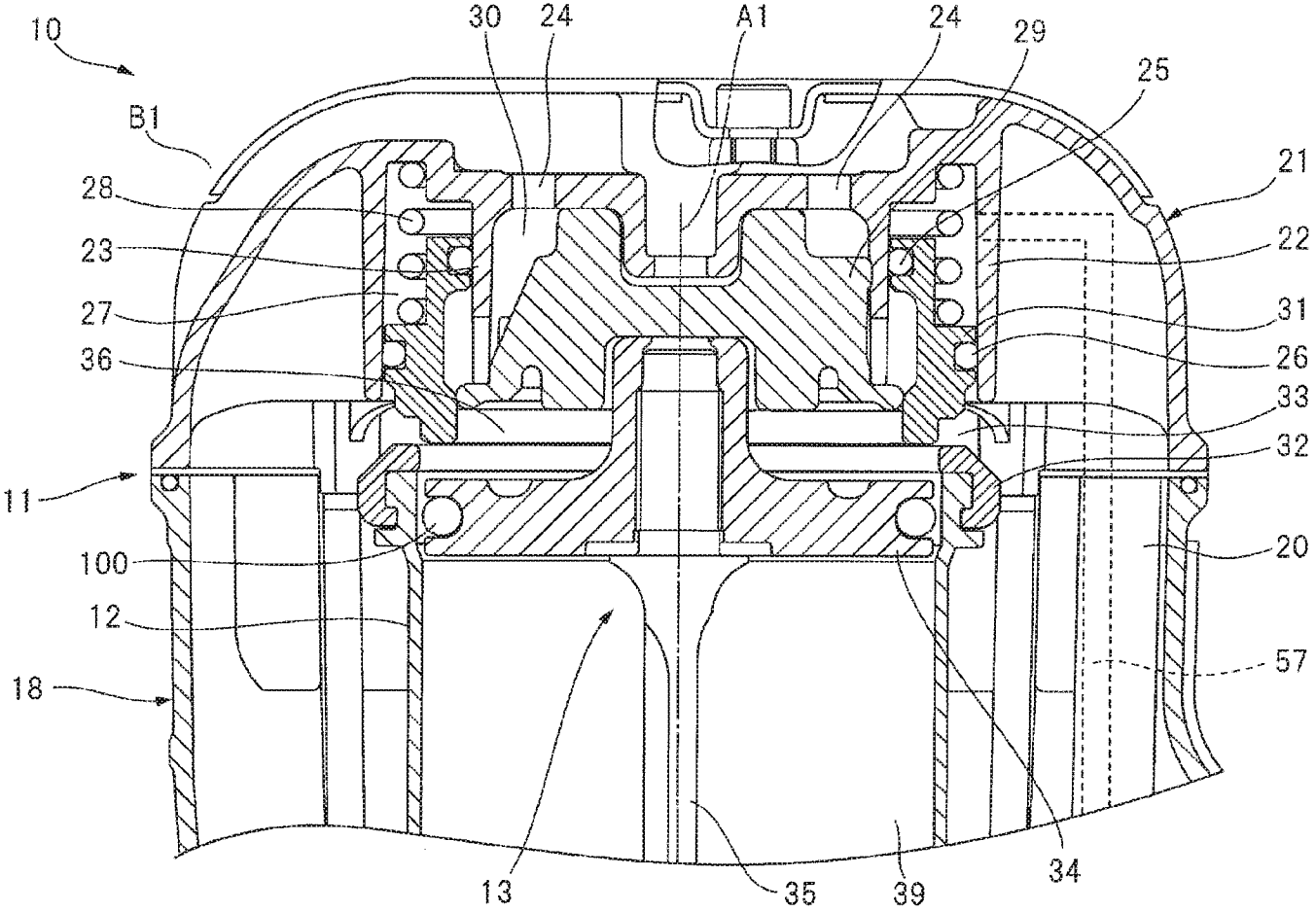
FIG. 3B is a partial cross-sectional view of the driver of FIG. 1, showing the state where the head valve opens the port.

As shown in FIGS. 1, 3A, and 3B, a pressure accumulation chamber 20 is formed across an inside of the handle 19, an inside of the body portion 18, and an inside of the head cover 21. An air hose is connected to the handle 19. Compressed air as compressed gas is supplied into the pressure accumulation chamber 20 through the air hose. The cylinder 12 is provided in the body portion 18. The head cover 21 has an outer tubular portion 22, an inner tubular portion 23, and an exhaust passage 24. The outer tubular portion 22 and the inner tubular portion 23 are arranged concentrically about a center line A1. The inner tubular portion 23 is provided inside the outer tubular portion 22.

A head valve 31 is provided in the head cover 21. The head valve 31 has a cylindrical shape and is arranged between the outer tubular portion 22 and the inner tubular portion 23. The head valve 31 is movable in the direction of the center line A1 of the cylinder 12. Sealing members 25 and 26 are attached to the head valve 31. A control chamber 27 is formed between the outer tubular portion 22 and the inner tubular portion 23. The sealing members 25 and 26 hermetically seal the control chamber 27. A biasing member 28 is provided in the control chamber 27. The biasing member 28 is, for example, a metal compression coil spring. The biasing member 28 biases the head valve 31 toward the cylinder 12 in the direction of the center line A1.

A stopper 29 is provided in the head cover 21. The stopper 29 is made of, for example, synthetic rubber, and a part of the stopper 29 is arranged inside the inner tubular portion 23. A passage 30 is formed between the inner tubular portion 23 and the stopper 29, and the passage 30 is connected to the exhaust passage 24. The exhaust passage 24 is connected to an outside B1 of the main body 11.

The cylinder 12 is fixed to the body portion 18 so as to be positioned in the direction of the center line A1. In the cylinder 12, a valve seat 32 is attached to an end portion of the cylinder 12 that is closest to the head valve 31 in the direction of the center line A1. The valve seat 32 has an annular shape and is made of synthetic rubber. A port 33 is formed between the head valve 31 and the valve seat 32. When the head valve 31 is pressed to the valve seat 32 as shown in FIG. 3A, the head valve 31 closes the port 33. When the head valve 31 is separated from the valve seat 32 as shown in FIG. 3B, the head valve 31 opens the port 33.

The striking portion 13 includes a piston 34 and a driver blade 35 fixed to the piston 34. The piston 34 is arranged in the cylinder 12, and the piston 34 is movable in the direction of the center line A1. A sealing member 100 is attached to an outer peripheral surface of the piston 34. An upper piston chamber 36 is formed between the stopper 29 and the piston 34. As shown in FIG. 3B, when the head valve 31 opens the port 33, the pressure accumulation chamber 20 is connected to the upper piston chamber 36. As shown in FIG. 3A, when the head valve 31 closes the port 33, the pressure accumulation chamber 20 is disconnected from the upper piston chamber 36.

The ejection portion 15 is fixed to an end portion of the body portion 18 on a side opposite to the head cover 21 in the direction of the center line A1.

Figure 3C:
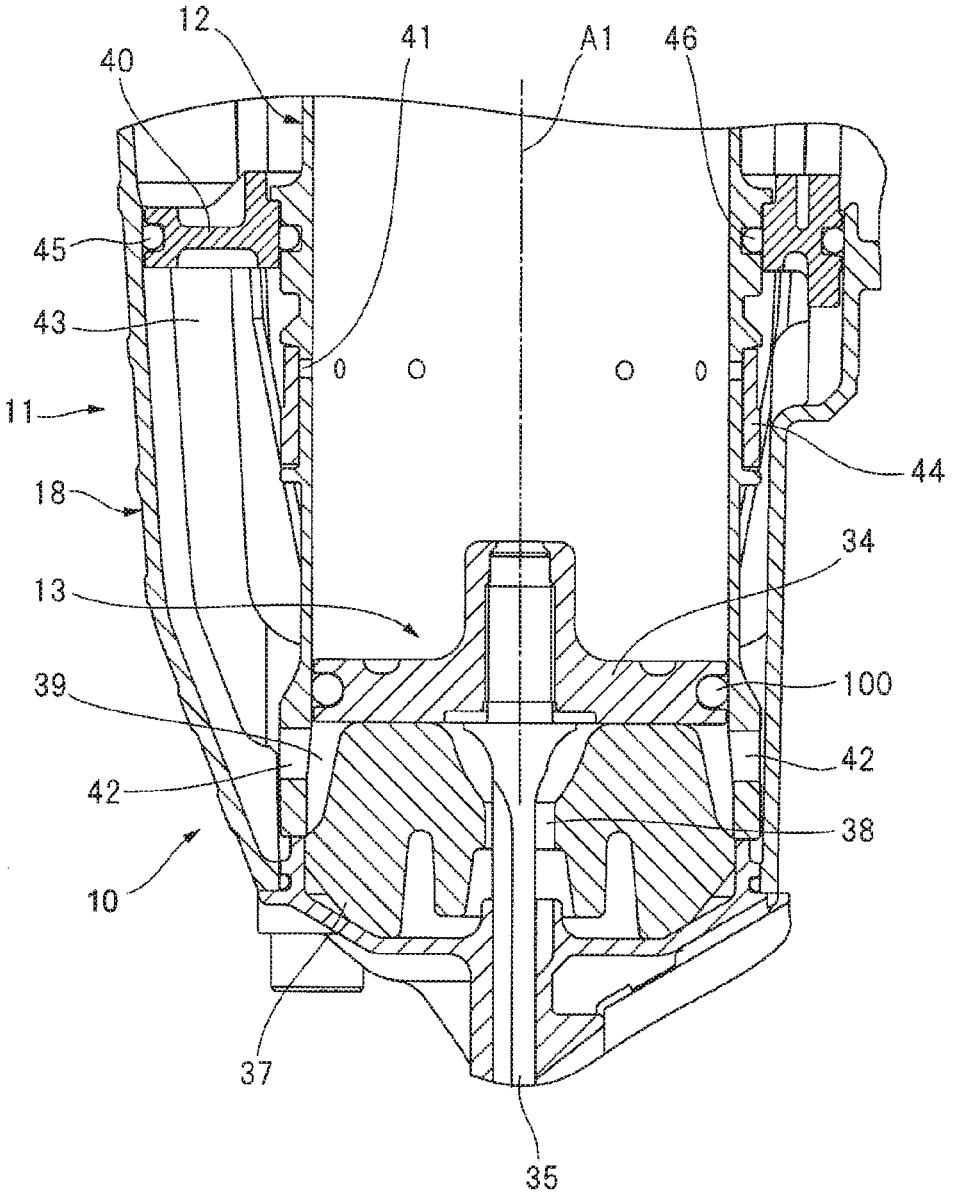
FIG. 3C is a partial cross-sectional view of the driver of FIG. 1, showing the state where a striking portion is at the bottom dead center.

As shown in FIGS. 1 and 3C, a bumper 37 is provided in the cylinder 12. The bumper 37 is arranged at a position closest to the ejection portion 15 in the direction of the center line A1 in the cylinder 12. The bumper 37 is made of synthetic rubber or silicone rubber. The bumper 37 has a shaft hole 38, and the driver blade 35 is movable in the shaft hole 38 in the direction of the center line A1. In the cylinder 12, a lower piston chamber 39 is formed between the piston 34 and the bumper 37. The sealing member 100 hermetically disconnects the lower piston chamber 39 and the upper piston chamber 36.

A holder 40 is provided in the body portion 18. The holder 40 has a tubular shape. The holder 40 is concentric with the cylinder 12 and is arranged outside the cylinder 12. Passages 41 and 42 penetrating the cylinder 12 in the radial direction are provided. The passage 42 is disposed between the passage 41 and the ejection portion 15 in the direction of the center line A1. A return air chamber 43 is formed between the outer surface of the cylinder 12 and the body portion 18. The passage 41 connects the lower piston chamber 39 and the return air chamber 43. A check valve 44 is provided on the cylinder 12. The check valve 44 opens the passage 41 when the air in the cylinder 12 is to flow into the return air chamber 43. The check valve 44 closes the passage 41 when the air in the return air chamber 43 is to flow into the cylinder 12. The passage 42 constantly connects the return air chamber 43 and the lower piston chamber 39. Compressed air is enclosed throughout the lower piston chamber 39 and the return air chamber 43. A sealing member 45 is provided between the holder 40 and the body portion 18, and a sealing member 46 is provided between the holder 40 and the cylinder 12. The sealing members 45 and 46 hermetically disconnect the pressure accumulation chamber 20 and the return air chamber 43 from each other.

Figure 4A:
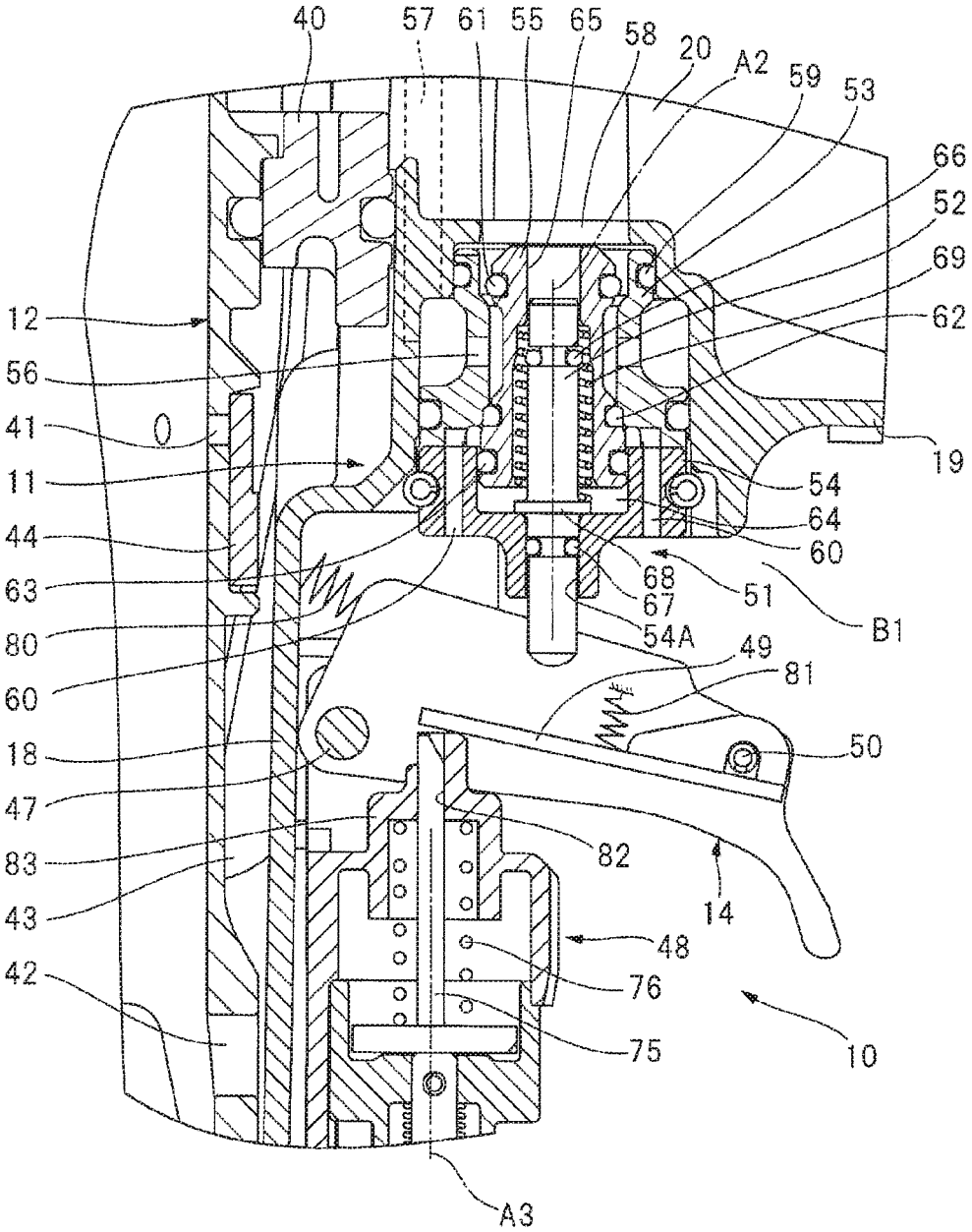
FIG. 4A is a partial cross-sectional view showing a trigger valve provided in the driver of FIG. 1, in which a trigger and a transmission member are at initial positions.
Figure 5A:
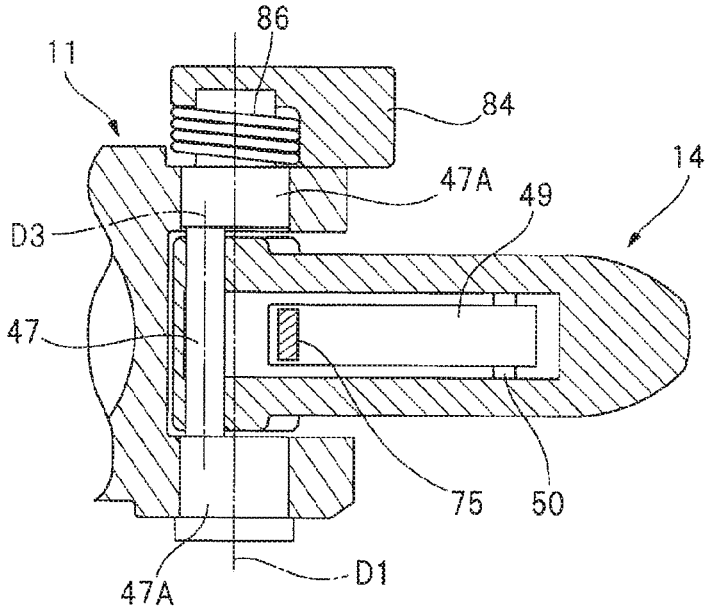
FIG. 5A is a bottom cross-sectional view showing the state where a switching lever provided in the driver of FIG. 1 is at a second operation position.

As shown in FIGS. 4A and 5A, the trigger 14 is attached to the main body 11. The trigger 14 is attached to the main body 11 via a support shaft 47. A boss portion 47A is provided at each of the longitudinal end portions of the support shaft 47. The two boss portions 47A have a columnar shape, and the two boss portions 47A are rotatable with respect to the main body 11 within a range of a predetermined angle about a center line D1. The support shaft 47 is provided about a center line D3 that is eccentric from the center line D1.

A mode selection member 84 is fixed to one boss portion 47A. The mode selection member 84 is an element that is operated by a worker to select a driving mode performed by the driver 10. The mode selection member 84 is, for example, a lever or a knob. The driving mode includes single firing and continuous firing. When the worker operates the mode selection member 84, the two boss portions 47A can rotate about the center line D1. When the two boss portions 47A are actuated about the center line D1, the support shaft 47 revolves about the center line D1. The trigger 14 can rotate about the center line D3 and can revolve about the center line D1.

The worker holds the handle 19 by hand and applies or releases an operation force to or from the trigger 14 with a finger. The mode selection member 84 is an element for switching the usage mode of the driver 10 between the single firing and the continuous firing. The mode selection member 84 has a first operation position corresponding to the single firing and a second operation position corresponding to the continuous firing.

Figure 6A:
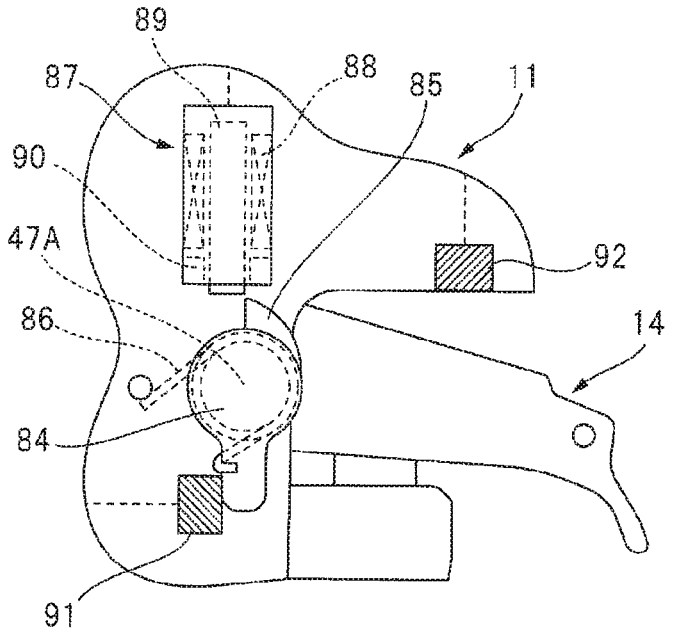
FIG. 6A is a schematic diagram showing the state where the switching lever provided in the driver of FIG. 1 is at the second operation position and a plunger of a solenoid is at an initial position.

As shown in FIG. 6A, the mode selection member 84 is provided with an engaging portion 85. Further, a biasing member 86 that biases the mode selection member 84 is provided. The biasing member 86 biases the mode selection member 84 clockwise in FIG. 6A. The biasing member 86 is, for example, a metal spring.

The trigger 14 can be actuated within a range of a predetermined angle about the support shaft 47. A biasing member 80 that biases the trigger 14 is provided. The biasing member 80 biases the trigger 14 clockwise about the support shaft 47. The biasing member 80 is, for example, a metal spring. A tubular holder 48 is attached to the main body 11. The holder 48 has a guide hole 82 and a support portion 83. The trigger 14 biased by the biasing member 80 comes into contact with the support portion 83 and is stopped at an initial position.

As shown in FIG. 4A, an arm 49 is attached to the trigger 14. The arm 49 can be actuated with respect to the trigger 14 about a support shaft 50 within a range of a predetermined angle. The support portion 83 is disposed between the support shaft 47 and the support shaft 50 in the length direction of the trigger 14. The support shaft 50 is provided in the trigger 14, and the support shaft 50 is provided at a position different from the support shaft 47. A biasing member 81 that biases the arm 49 about the support shaft 50 is provided. The biasing member 81 biases the arm 49 counterclockwise in FIG. 4A. The biasing member 81 is, for example, a metal spring. A free end of the arm 49 biased by the biasing member 81 comes into contact with the support portion 83 and is stopped at an initial position.

As shown in FIGS. 1 and 4A, a trigger valve 51 is provided at a connection portion between the body portion 18 and the handle 19. The trigger 14 and the arm 49 are arranged between the holder 48 and the trigger valve 51 in the direction of the center line A1 shown in FIG. 1. The trigger valve 51 has a plunger 52, a first body 53, a second body 54, a valve body 55, and a biasing member 69. The first body 53 and the second body 54 both have a tubular shape, and the first body 53 and the second body 54 are arranged concentrically about a center line A2. The valve body 55 is disposed across an inside of the first body 53 and an inside of the second body 54. A passage 56 is formed in the first body 53, and the passage 56 is connected to the control chamber 27 via a passage 57.

Further, the handle 19 has a passage 58, and the passage 58 connects the pressure accumulation chamber 20 and the inside of the first body 53. A sealing member 59 that seals between the first body 53 and the main body 11 is provided. The second body 54 has a passage 60 and a shaft hole 54A. The passage 60 is connected to the outside B1 of the main body 11. The second body 54 has a space 64 connected to the shaft hole 54A.

Sealing members 61, 62, and 63 are attached to an outer peripheral surface of the valve body 55. The valve body 55 has a shaft hole 65. The sealing member 63 hermetically seals the space 64. The plunger 52 is disposed across an inside of the shaft holes 54A and 65. Sealing members 66 and 67 are attached to an outer peripheral surface of the plunger 52. A flange 68 projecting from an outer peripheral surface of the plunger 52 is provided. The biasing member 69 is provided in the shaft hole 65. The biasing member 69 is, for example, a compression spring, and the biasing member 69 biases the plunger 52 toward the arm 49 in the direction of the center line A2.

As shown in FIG. 1, the ejection portion 15 is made of, for example, metal or non-ferrous metal. The ejection portion 15 has a tubular portion 70 and a flange 71 connected to an outer peripheral surface of the tubular portion 70. The flange 71 is fixed to the body portion 18 by a fixing element. The tubular portion 70 has an ejection path 72. The center line A1 is located in the ejection path 72, and the driver blade 35 is movable in the ejection path 72 in the direction of the center line A1.

The magazine 17 is fixed to the ejection portion 15. The magazine 17 stores nails 73. The magazine 17 has a feeder 74, and the feeder 74 sends the nails 73 in the magazine 17 to the ejection path 72.

A transmission member 75 connected so as to be able to transmit power to the push lever 16 is provided. As shown in FIG. 4A, the transmission member 75 is supported by the holder 48. A part of the transmission member 75 is disposed in the guide hole 82. The transmission member 75 is movable with respect to the holder 48 in the direction of a center line A3. The center line A3 is parallel to the center line A2. When the transmission member 75 comes into contact with the arm 49, the actuation force of the push lever 16 is transmitted to the arm 49. When the transmission member 75 is separated from the arm 49, the actuation force of the push lever 16 is not transmitted to the arm 49. The transmission member 75 is biased by a biasing member 76 in the direction away from the arm 49. The biasing member 76 is, for example, a metal spring.

Further, a solenoid 87 shown in FIG. 6A is provided in the main body 11. The solenoid 87 is a keep solenoid having a coil 88, a plunger 89, and a ring-shaped permanent magnet 90. The plunger 89 is made of, for example, a magnetic material such as iron or steel. When a current flows through the coil 88 in the solenoid 87, the plunger 89 is actuated in the axial direction against the attractive force of the permanent magnet 90. When a controller 94 switches the direction of the current supplied to the coil 88, the direction in which the plunger 89 is actuated can be changed. When the controller 94 shuts off the power supply to the coil 88, the plunger 89 is stopped at a predetermined axial position by the attractive force of the permanent magnet 90. The plunger 89 is stopped at either the initial position shown in FIG. 6A or the actuated position shown in FIG. 6B.

Figure 7:
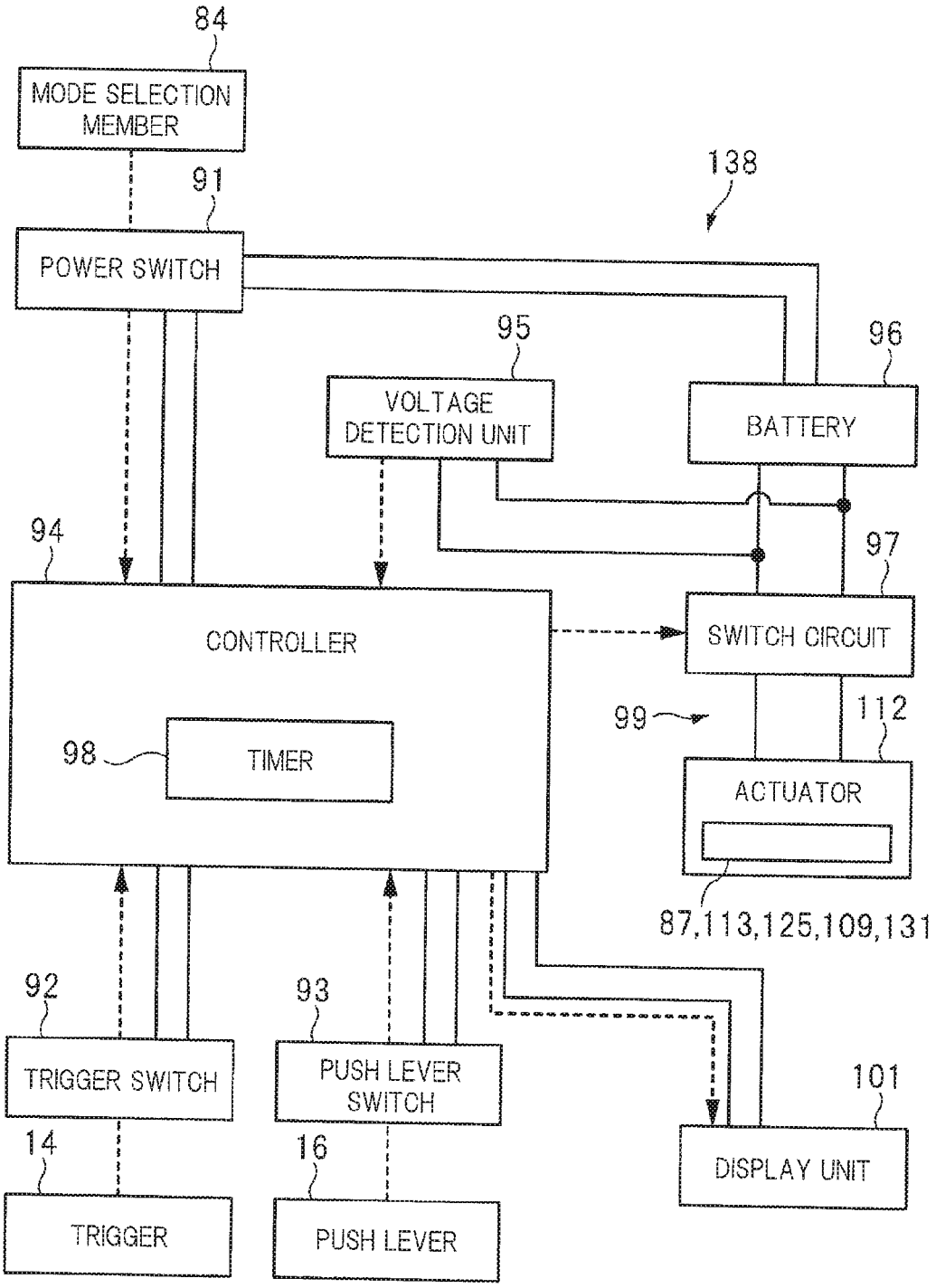
FIG. 7 is a block diagram showing a control system of the driver of FIG. 1.

FIG. 7 is a block diagram showing a control system of the driver 10. The driver 10 is provided with a power switch 91, a trigger switch 92, a push lever switch 93, the controller 94, a voltage detection unit 95, a battery 96, a switch circuit 97, and an actuator 112. The battery 96 is connected to the controller 94 via an electric circuit 138. The power switch 91 is turned off when the mode selection member 84 is at the first operation position, and is turned on when the mode selection member 84 is at the second operation position.

The trigger switch 92 is turned on when an operation force is applied to the trigger 14, and is turned off when the operation force of the trigger 14 is released. The push lever switch 93 is turned on when the push lever 16 is pressed to the workpiece 77, and is turned off when the push lever 16 is separated from the workpiece 77. The power switch 91, the trigger switch 92, and the push lever switch 93 may be either contact switches or non-contact switches. The signals from the power switch 91, the trigger switch 92, and the push lever switch 93 are input to the controller 94.

The controller 94 is a microcomputer having an input interface, an output interface, a storage unit, an arithmetic processing unit, and a timer 98. The controller 94 processes the ON and OFF signals of the power switch 91 to determine the operation position of the mode selection member 84. When the power switch 91 is turned on, the electric circuit 138 is connected and the power of the battery 96 is supplied to the controller 94. When the power switch 91 is off, the electric circuit 138 is disconnected and the power of the battery 96 is not supplied to the controller 94. The controller 94 is activated when the power is supplied from the battery 96, and stops when the power is not supplied from the battery 96.

Further, the power switch 91 may include a semiconductor switch in addition to a mode switch that determines the operation position of the mode selection member 84. In this case, the mode switch only determines the operation position of the mode selection member 84, and does not have a function of connecting and disconnecting the electric circuit 138. Then, the controller 94 determines the operation position of the mode selection member 84 by the mode switch, and the controller 94 can connect and disconnect the electric circuit 138 by controlling ON and OFF of the semiconductor switch. The mode switch may be either a contact switch or a non-contact switch. The contact switch is, for example, a tactile switch, and the non-contact switch is, for example, an optical sensor, a magnetic sensor, or an infrared sensor. The controller 94 can be provided in any part of the main body 11, for example, in the magazine 17.

The battery 96 is a power source that supplies electric power to the controller 94 and the actuator 112, and a secondary battery that can be charged and discharged can be used for it. Supplying a current through the actuator 112 can be defined as turning on the actuator 112. Stopping the supply of current to the actuator 112 can be defined as turning off the actuator 112.

In the driver 10 according to the first embodiment, the solenoid 87 corresponds to the actuator 112. The battery 96 may be a primary battery. The battery 96 is detachably attached to the main body 11, for example, to the magazine 17. The switch circuit 97 is provided in an electric circuit 99 formed between the battery 96 and the solenoid 87. The switch circuit 97 has a function of connecting and disconnecting the electric circuit 99 and a function of switching the direction of current supplied from the battery 96 to the solenoid 87. The switch circuit 97 includes, for example, a plurality of field effect transistors. The controller 94 controls the switch circuit 97 to connect or disconnect the electric circuit 99. Also, the controller 94 can switch the direction of the current supplied to the coil 88 of the solenoid 87 by controlling the switch circuit 97. Further, the voltage detection unit 95 detects the voltage of the battery 96 and inputs a signal to the controller 94. In addition, a display unit 101 is connected to the controller 94. The display unit 101 includes a liquid crystal display and a light emitting diode lamp. The controller 94 causes the display unit 101 to display the voltage of the battery 96 and the operation position of the mode selection member 84.

Next, an example in which the nail 73 shown in FIG. 1 is driven into the workpiece 77 with use of the driver 10 will be described. First, the user can select the single firing or the continuous firing by operating the mode selection member 84. The mode selection member 84 shown in FIG. 2 is located the first operation position corresponding to the single firing, and the mode selection member 84 shown in FIG. 6A is located at the second operation position corresponding to the continuous firing. The second operation position of the mode selection member 84 is a position where the mode selection member 84 is actuated by about 90 degrees clockwise with respect to the first operation position of the mode selection member 84.

The position of the support shaft 47 which is the actuation center of the trigger 14 will be described. The support shaft 47 is eccentric with respect to the two boss portions 47A. Therefore, when the operation position of the mode selection member 84 changes, the position of the support shaft 47 with respect to the transmission member 75 changes. When the operation position of the mode selection member 84 changes, the position of the support shaft 47 with respect to the transmission member 75 changes in the direction intersecting the center line A3. The distance from the support shaft 47 to the transmission member 75 shown in FIG. 8A when the mode selection member 84 is stopped at the first operation position is smaller than the distance from the support shaft 47 to the transmission member 75 shown in FIG. 4A when the mode selection member 84 is stopped at the second operation position.

Example of Selecting Single Firing in Driver

An example in which the worker selects the single firing by stopping the mode selection member 84 at the first operation position shown in FIG. 2 will be described with reference to FIGS. 8A, 8B, 8C, and 8D. When the worker selects the single firing, the power switch 91 is turned off. Namely, the power of the battery 96 is not supplied to the controller 94, and the power of the battery 96 is not supplied to the solenoid 87. Therefore, the plunger 89 is stopped at the initial position attracted by the permanent magnet 90. Accordingly, the plunger 89 is separated from the engaging portion 85.

Also, when at least one of the conditions that the operation force to the trigger 14 is released and the push lever 16 is separated from the workpiece 77 is satisfied in the state where the single firing is selected, the trigger valve 51, the head valve 31, and the striking portion 13 of the driver 10 are in the following initial states.

Figure 8A:
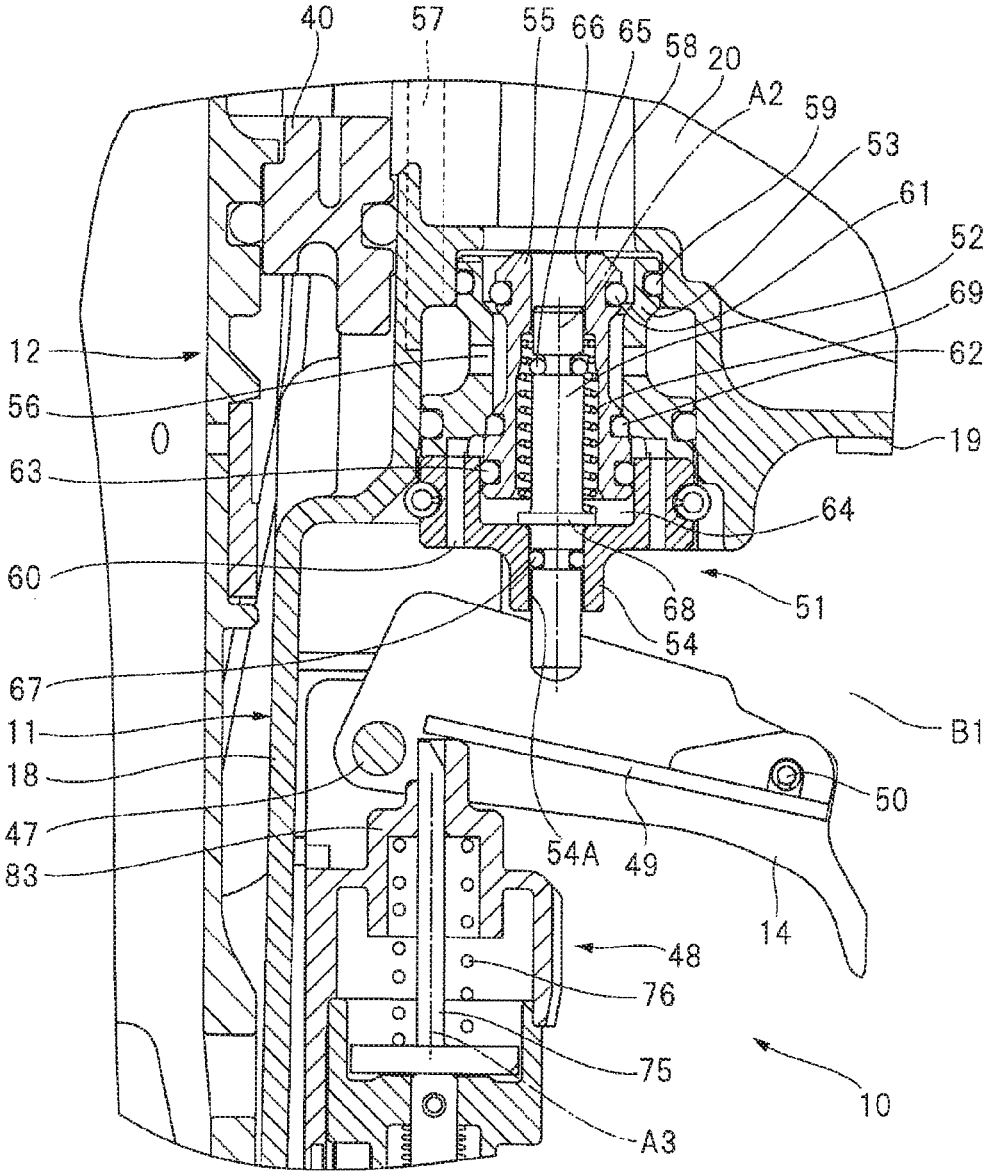
FIG. 8A is a partial cross-sectional view showing the trigger valve provided in the driver of FIG. 1, in which the trigger and the transmission member are at the initial positions.
Figure 8B:
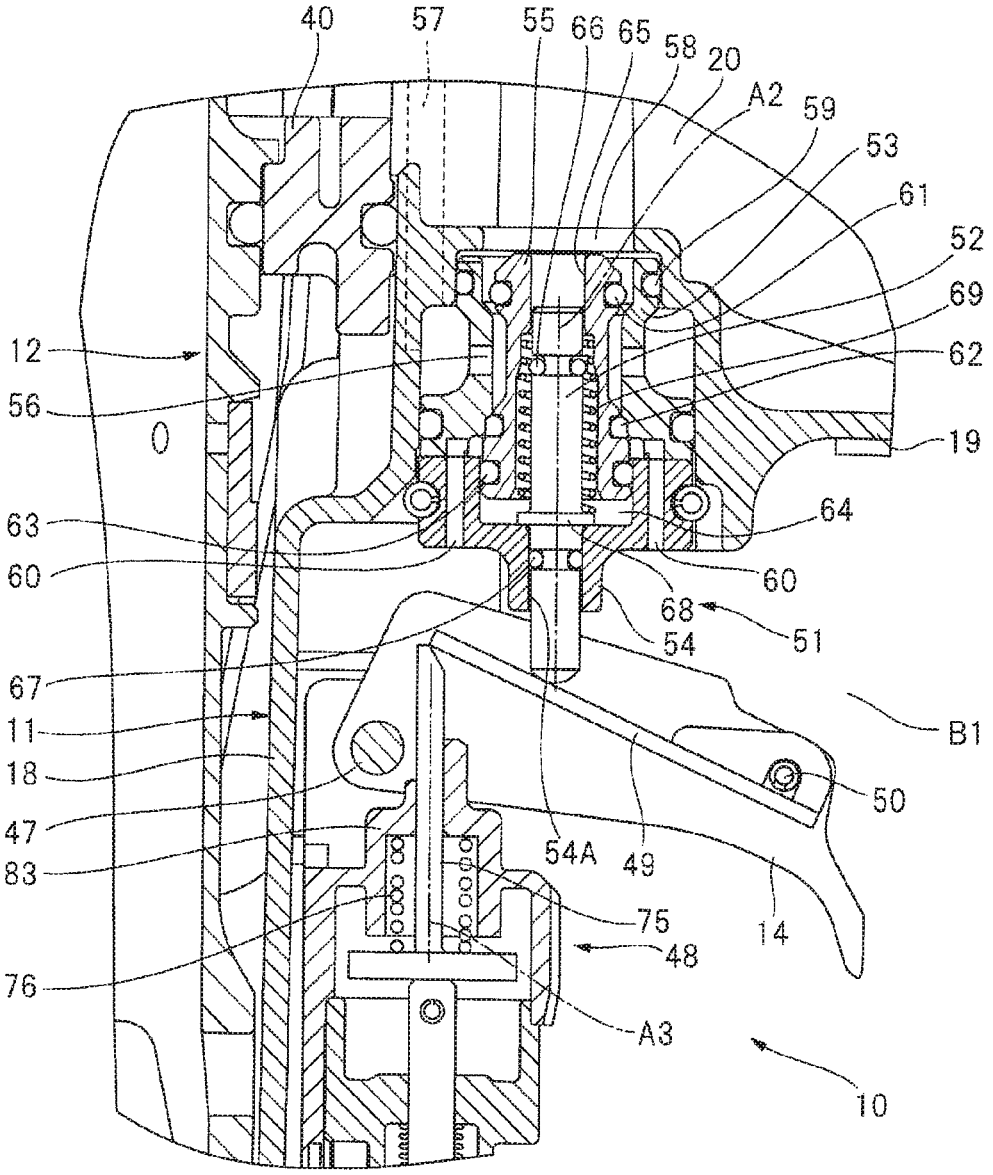
FIG. 8B is a partial cross-sectional view showing the trigger valve provided in the driver of FIG. 1, in which the trigger is at the initial position and the transmission member is at the actuated position.

As shown in FIG. 8A, the transmission member 75 does not project from the support portion 83 in the direction of the center line A3. Also, the trigger 14 is in contact with the supporting portion 83 and is stopped at the initial position. Further, the arm 49 is in contact with the support portion 83 and is stopped at the initial position. The tip of the arm 49 is within the actuation range of the transmission member 75. However, the transmission member 75 is stopped at the initial position separated from the arm 49. In addition, the arm 49 is separated from the plunger 52. Namely, no actuation force is applied from the arm 49 to the plunger 52.

The flange 68 is pressed to the second body 54 by the biasing member 69. The valve body 55 is biased by the biasing force of the biasing member 69 in the direction away from the arm 49, and the sealing member 62 is pressed to the first body 53, so that the valve body 55 is stopped at the initial position.

The sealing member 62 disconnects the passage 56 and the passage 60. The sealing member 61 is separated from the first body 53, and the pressure accumulation chamber 20 is connected to the control chamber 27 via the passage 58, the passage 56, and the passage 57. The sealing member 66 is separated from the valve body 55, and the pressure accumulation chamber 20 is connected to the space 64 via the passage 58 and the shaft hole 65. The sealing member 67 seals the shaft hole 54A to disconnect the space 64 and the outside B1.

Since the compressed air of the pressure accumulation chamber 20 is supplied to the control chamber 27, the head valve 31 is pressed to the valve seat 32 by the biasing force of the biasing member 28 and the pressure of the control chamber 27 as shown in FIG. 3A. The head valve 31 closes the port 33. Also, the inner peripheral surface of the head valve 31 is separated from the outer peripheral end of the stopper 29. The upper piston chamber 36 is connected to the outside B1 via the passage 30 and the exhaust passage 24. Therefore, the pressure of the upper piston chamber 36 is equal to the atmospheric pressure and is lower than the pressure of the lower piston chamber 39. Accordingly, the piston 34 is stopped while being pressed to the stopper 29 by the pressure of the lower piston chamber 39. As described above, the striking portion 13 is stopped at the top dead center shown in FIGS. 1 and 3A.

Next, when the worker presses the push lever 16 to the workpiece 77, the actuation force of the push lever 16 is transmitted to the transmission member 75. The transmission member 75 is actuated in the direction of approaching the trigger valve 51 from the initial position against the biasing force of the biasing member 76. Then, the transmission member 75 projects from the support portion 83, and the actuation force of the transmission member 75 is transmitted to the arm 49. The arm 49 is actuated clockwise about the support shaft 50, and when the transmission member 75 is stopped at the actuated position shown in FIG. 8B, the arm 49 is also stopped at the intermediate position. In this state, the actuation force of the arm 49 is not transmitted to the plunger 52, and the plunger 52 is stopped at the initial position.

When the worker applies an operation force to the trigger 14 in the state where the push lever 16 is being pressed to the workpiece 77, the trigger 14 is actuated counterclockwise about the support shaft 47. Then, the arm 49 is actuated counterclockwise with the transmission member 75 as a fulcrum, and the actuation force of the arm 49 is transmitted to the plunger 52. The plunger 52 is actuated from the initial position against the biasing force of the biasing member 69. When the trigger 14 is stopped at the actuated position as shown in FIG. 8C, the arm 49 is stopped at the actuated position and the plunger 52 is stopped at the actuated position.

Figure 8C:
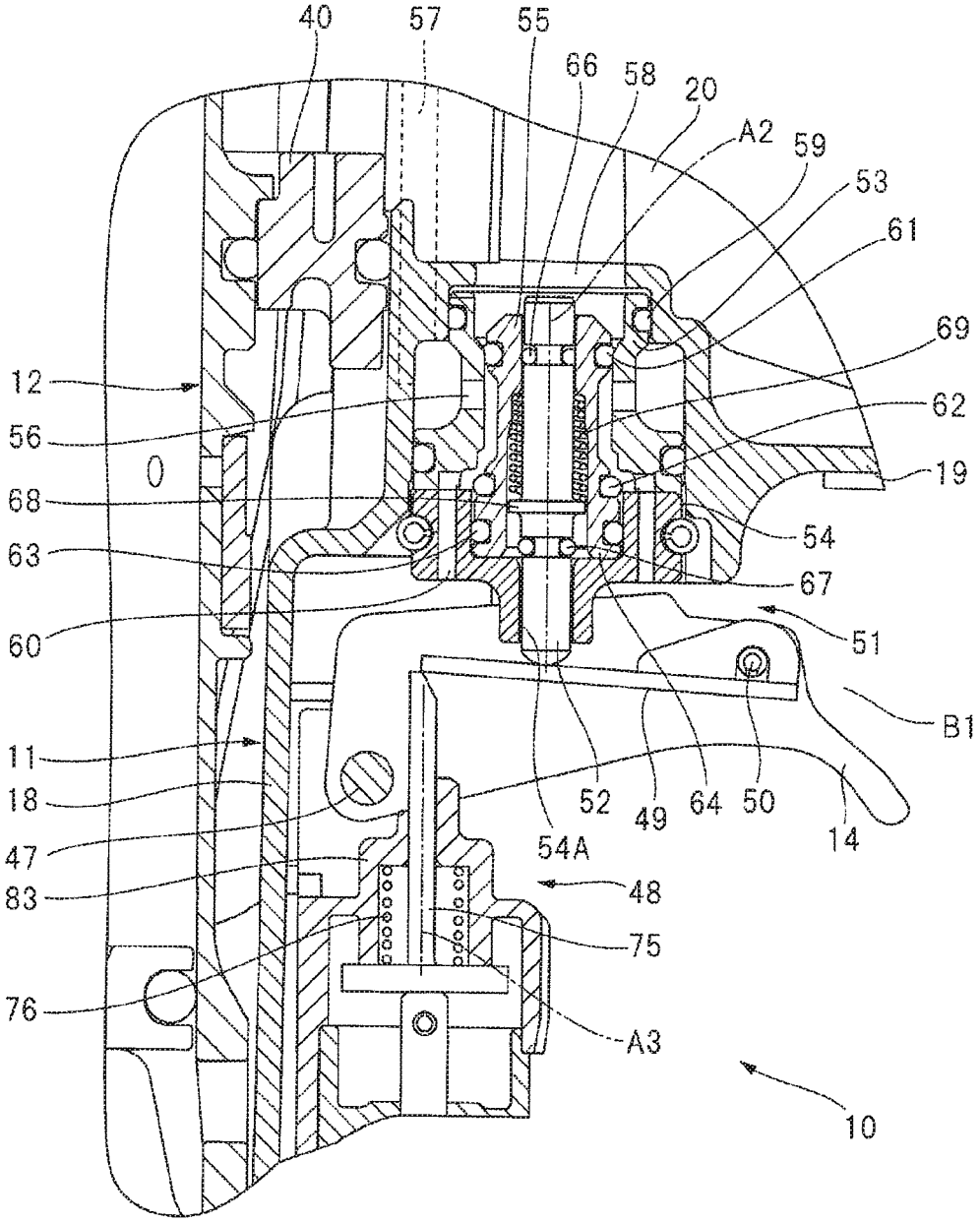
FIG. 8C is a partial cross-sectional view showing the trigger valve provided in the driver of FIG. 1, in which the trigger is at the actuated position and the transmission member is at the actuated position.

When the plunger 52 is stopped at the actuated position shown in FIG. 8C, the sealing member 66 seals the shaft hole 65. The sealing member 67 moves to the space 64, and the space 64 and the outside B1 are connected via the shaft hole 54A. Therefore, the valve body 55 is actuated by the pressure of the compressed air of the pressure accumulation chamber 20 against the force of the biasing member 69, and the sealing member 61 disconnects the pressure accumulation chamber 20 and the passage 56. Also, the sealing member 62 separates from the first body 53, and the passage 56 and the passage 60 are connected. Therefore, the compressed air of the control chamber 27 is discharged to the outside B1 through the passage 57, the passage 56, and the passage 60, and the pressure of the control chamber 27 becomes equal to the atmospheric pressure.

When the pressure of the control chamber 27 becomes equal to the atmospheric pressure, the head valve 31 is actuated by the pressure of the pressure accumulation chamber 20 against the biasing force of the biasing member 28. Therefore, the head valve 31 opens the port 33 as shown in FIG. 3B, and the pressure accumulation chamber 20 is connected to the upper piston chamber 36 via the port 33. Further, the head valve 31 comes into contact with the stopper 29, and the head valve 31 disconnects the upper piston chamber 36 and the exhaust passage 24. Then, the compressed air of the pressure accumulation chamber 20 is supplied to the upper piston chamber 36, and the pressure of the upper piston chamber 36 rises. When the pressure of the upper piston chamber 36 becomes higher than the pressure of the lower piston chamber 39, the striking portion 13 is actuated from the top dead center to the bottom dead center in the direction of the center line A1, and the driver blade 35 strikes the nail 73 in the ejection path 72. The struck nail 73 is driven into the workpiece 77.

After the striking portion 13 drives the nail 73 into the workpiece 77, the piston 34 collides with the bumper 37 as shown in FIG. 3C, and the bumper 37 absorbs a part of the kinetic energy of the striking portion 13. The position of the striking portion 13 at the time when the piston 34 collides with the bumper 37 is the bottom dead center. Also, the check valve 44 opens the passage 41 while the striking portion 13 is being actuated from the top dead center to the bottom dead center, and the compressed air of the lower piston chamber 39 flows into the return air chamber 43 from the passage 41.

Figure 8D:
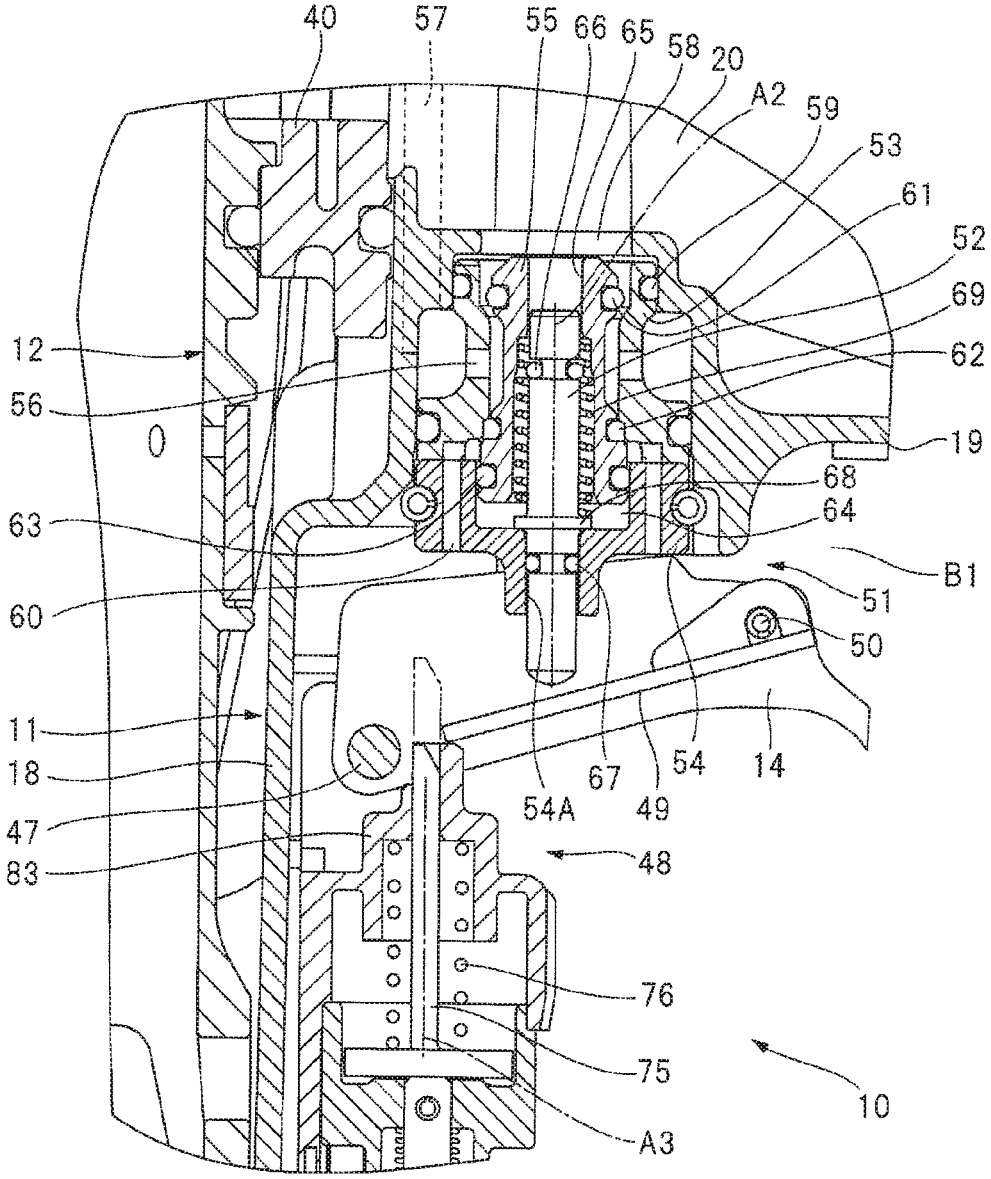
FIG. 8D is a partial cross-sectional view showing the trigger valve provided in the driver of FIG. 1, in which the trigger is at the actuated position and the transmission member is at the initial position.

When the worker separates the push lever 16 from the workpiece 77, the transmission member 75 returns from the actuated position to the initial position and is stopped there by the biasing force of the biasing member 76 as shown in FIG. 8D. Also, when the operation force to the trigger 14 is released, the trigger 14 returns from the actuated position to the initial position, and the arm 49 returns from the actuated position to the initial position and is stopped there by the biasing force of the biasing member 81.

Further, the plunger 52 returns from the actuated position to the initial position, and the head valve 31 returns to the initial state to close the port 33. Then, the pressure of the upper piston chamber 36 becomes equal to the atmospheric pressure, and the piston 34 is actuated from the bottom dead center toward the top dead center by the pressure of the lower piston chamber 39. Further, the compressed air of the return air chamber 43 flows into the lower piston chamber 39 through the passage 42, and the striking portion 13 returns to the top dead center and is stopped there.

Next, an example in which the trigger 14 is stopped at the actuated position shown in FIG. 8D when the push lever 16 is separated from the workpiece 77 will be described. In this case, the arm 49 is actuated counterclockwise about the support shaft 50 by the biasing force of the biasing member 81 in the process of the transmission member 75 returning from the actuated position to the initial position. Then, in the state where the transmission member 75 is stopped at the initial position, the arm 49 returns to the intermediate position and is stopped there.

Figure 5B:
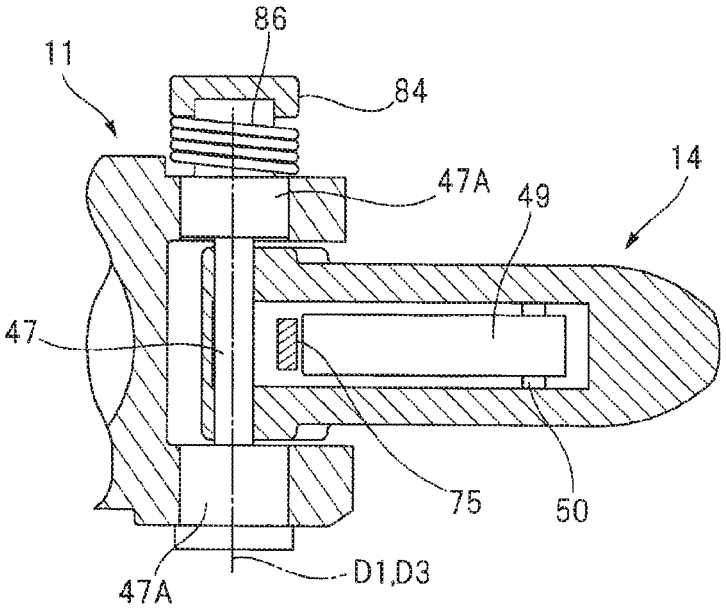
FIG. 5B is a bottom cross-sectional view showing the state where the switching lever provided in the driver of FIG. 1 is at a first operation position.

When the transmission member 75 is stopped at the initial position and the arm 49 is stopped at the intermediate position as shown in FIG. 8D, the arm 49 is located at the position outside the actuation range of the transmission member 75 as shown in FIG. 5B. Therefore, even when the push lever 16 is pressed to the workpiece 77 again and the transmission member 75 is actuated from the initial position to the actuated position in the state where the trigger 14 is stopped at the actuated position, the actuation force of the transmission member 75 is not transmitted to the arm 49, and the plunger 52 is stopped at the initial position. Namely, the striking portion 13 is held in the state of being stopped at the top dead center.

Example of Selecting Continuous Firing in Driver

When the worker selects the continuous firing by stopping the mode selection member 84 at the second operation position as shown in FIGS. 5A and 6A, the power switch 91 is turned on. Then, the controller 94 is activated, and the controller 94 supplies power of the battery 96 to the solenoid 87. Then, the coil 88 forms a magnetic attractive force, and the plunger 89 is actuated from the initial position shown in FIG. 6A against the attractive force of the permanent magnet 90. When the controller 94 stops the power supply to the solenoid 87, the plunger 89 is stopped at the actuated position shown in FIG. 6B by the attractive force of the permanent magnet 90. Also, the mode selection member 84 is biased counterclockwise in FIG. 6B. Therefore, the engaging portion 85 is pressed to the plunger 89, and the mode selection member 84 is stopped at the second operation position.

Figure 2:
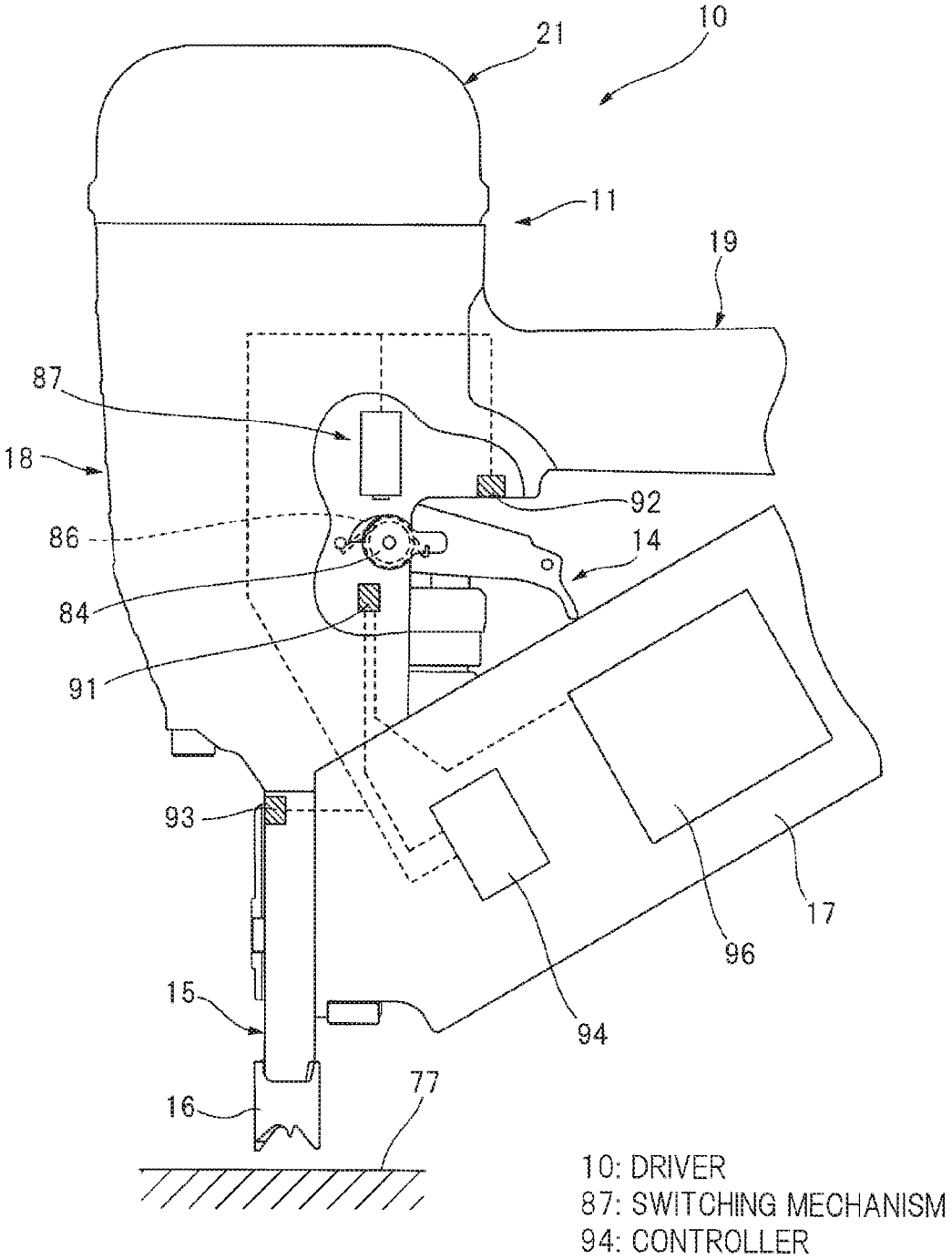
FIG. 2 is an external view of the driver of FIG. 1.

When the mode selection member 84 is stopped at the second operation position, the distance from the support shaft 47 to the transmission member 75 is larger when the mode selection member 84 is stopped at the second operation position as shown in FIGS. 5A and 6A than when the mode selection member 84 is stopped at the first operation position as shown in FIGS. 5B and 2. Namely, the length of the arm 49 located between the actuation range of the transmission member 75 and the support shaft 47 is larger when the mode selection member 84 is at the second operation position than when the mode selection member 84 is at the first operation position.

Further, when the controller 94 detects both the conditions that the trigger switch 92 is off and the push lever switch 93 is off in the state where the continuous firing is selected, the trigger 14 is stopped at the initial position, the transmission member 75 is stopped at the initial position, and the arm 49 is stopped at the initial position as shown in FIG. 4A. In addition, the trigger valve 51 connects the pressure accumulation chamber 20 and the passage 56, and disconnects the space 64 and the outside B1. Therefore, the head valve 31 closes the port 33 as shown in FIG. 3A, and the striking portion 13 is stopped at the top dead center.

Figure 4B:
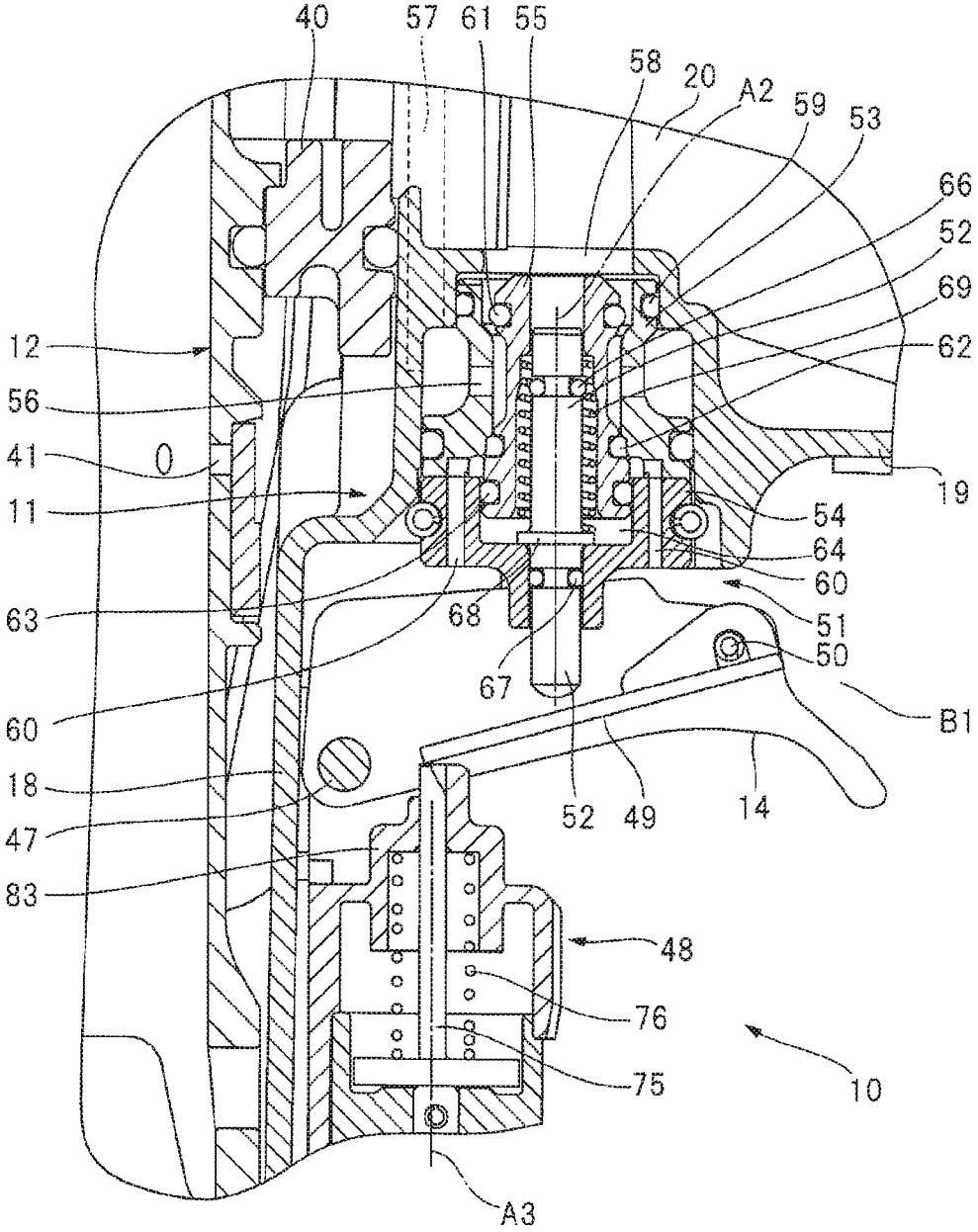
FIG. 4B is a partial cross-sectional view showing the trigger valve provided in the driver of FIG. 1, in which the trigger is at an actuated position and the transmission member is at the initial position.

Next, when the worker applies an operation force to the trigger 14, the trigger 14 is actuated counterclockwise from the initial position against the biasing force of the biasing member 80, and is stopped at the actuated position shown in FIG. 4B. Also, the trigger switch 92 is turned on. Further, the arm 49 is actuated with the support portion 83 as a fulcrum. However, since the push lever 16 is not pressed to the workpiece 77, the actuation force of the arm 49 is not transmitted to the plunger 52, and the plunger 52 is stopped at the initial position.

When the push lever 16 is pressed to the workpiece 77 in the state where the operation force is applied to the trigger 14, the push lever switch 93 is turned on. Also, the actuation force of the push lever 16 is transmitted to the transmission member 75, and the transmission member 75 is actuated from the initial position. Then, the transmission member 75 projects from the support portion 83, and the actuation force of the transmission member 75 is transmitted to the arm 49. The arm 49 is actuated clockwise about the support shaft 50, and when the transmission member 75 is stopped at the actuated position shown in FIG. 4C, the arm 49 is stopped at the actuated position.

Figure 4C:
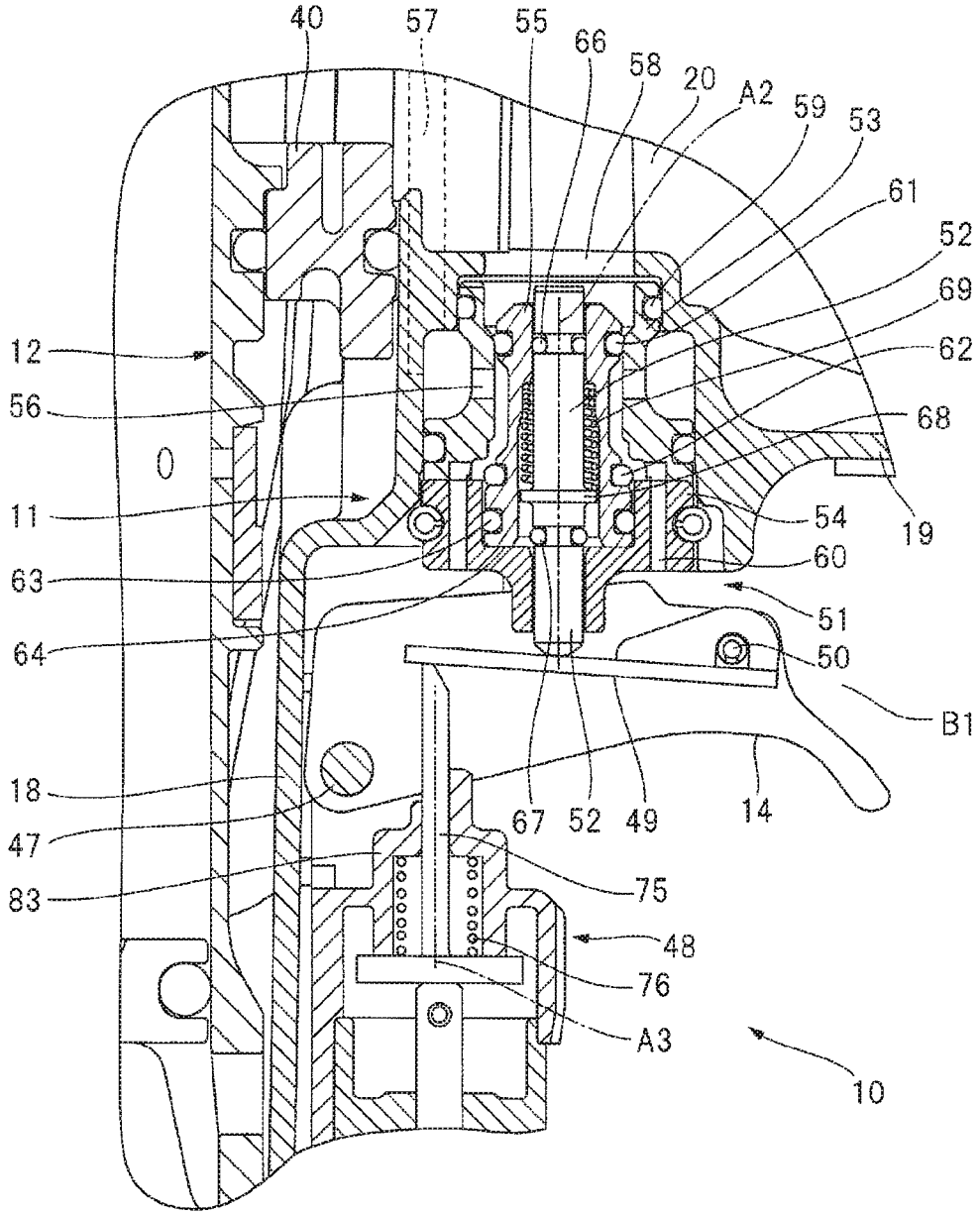
FIG. 4C is a partial cross-sectional view showing the trigger valve provided in the driver of FIG. 1, in which the trigger and the transmission member are at the actuated positions.

When the arm 49 is actuated from the initial position to the actuated position, the plunger 52 is actuated from the initial position and is stopped at the actuated position shown in FIG. 4C. Namely, the trigger valve 51 is in an actuated state in which it disconnects the pressure accumulation chamber 20 and the passage 56 and connects the space 64 and the outside B1. Therefore, the head valve 31 is stopped at the actuated position shown in FIG. 3 and opens the port 33. Accordingly, the striking portion 13 is actuated from the top dead center toward the bottom dead center, and the striking portion 13 drives the nail 73 into the workpiece 77.

When the worker separates the push lever 16 from the workpiece 77 after the striking portion 13 drives the nail 73 into the workpiece 77, the transmission member 75 returns from the actuated position to the initial position and is stopped there by the biasing force of the biasing member 76 as shown in FIG. 4B. Also, the arm 49 returns from the actuated position to the initial position and is stopped there.

When the arm 49 is stopped at the initial position, the tip of the arm 49 is located within the actuation range of the transmission member 75.

Also, the plunger 52 returns from the actuated position to the initial position and is stopped there. Therefore, the head valve 31 returns to the initial state and closes the port 33. Further, the piston 34 is actuated from the bottom dead center toward the top dead center by the pressure of the lower piston chamber 39. In addition, the compressed air of the return air chamber 43 flows into the lower piston chamber 39 through the passage 42, and the striking portion 13 returns to the top dead center and is stopped there.

Thereafter, in the state where the trigger 14 is being held at the actuated position, the worker can perform the continuous firing by alternately repeating the operation of pressing the push lever 16 to the workpiece 77 and the operation of separating the push lever 16 from the workpiece 77.

Next, a control example performed in the driver 10 will be described with reference to the flowchart of FIG. 9. When the worker selects the continuous firing in step S1, the power switch 91 is turned on and the controller 94 is activated in step S2. The controller 94 stores information necessary for control in the storage unit in advance. In step S3, the controller 94 determines whether the voltage of the battery 96 is equal to or higher than a specified value. The specified value corresponds to the voltage with which the operation of actuating the plunger 89 from the actuated position toward the initial position can be performed once or more by supplying the power of the battery 96 to the solenoid 87.

If the plunger 89 is currently stopped at the initial position, the specified value is the voltage with which the plunger 89 can be actuated from the initial position to the actuated position and can be returned from the actuated position to the initial position. If the plunger 89 is currently stopped at the actuated position, the specified value is the voltage with which the plunger 89 can be actuated from the actuated position toward the initial position.

Figure 6B:
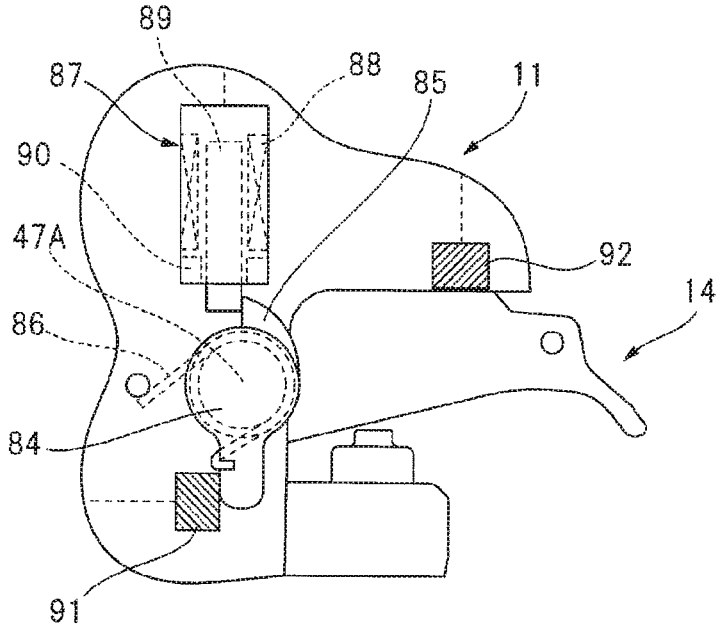
FIG. 6B is a schematic diagram showing the state where the switching lever provided in the driver of FIG. 1 is at the second operation position and the plunger of the solenoid is at an actuated position.

When the controller 94 determines Yes in step S3, it performs the process of step S4. The process of step S4 is to supply the current from the battery 96 to the solenoid 87, actuate the plunger 89 from the initial position to the actuated position, and then stop the supply of current to the solenoid 87. When the controller 94 performs the process of step S4, the plunger 89 is stopped at the actuated position by the attractive force of the permanent magnet 90, and the mode selection member 84 is stopped at the second operation position as shown in FIG. 6B.

When the controller 94 detects that the trigger switch 92 is turned on in step S5, it starts the timer 98 in step S6. The controller 94 makes the determination in step S7. The determination in step S7 is whether the push lever switch 93 is turned on within a predetermined time after the timer 98 is started. The predetermined time can be set to, for example, 3 seconds.

When the controller 94 determines Yes in step S7, it resets the timer 98 in step S8. Also, when the push lever 16 is pressed to the workpiece 77 and the plunger 52 moves to the actuated position by the actuation force of the arm 49 as shown in FIG. 4C, the striking portion 13 drives the nail 73 into the workpiece 77 in step S9.

The controller 94 determines in step S10 whether the voltage of the battery 96 is equal to or higher than the specified value in the state where the mode selection member 84 is stopped at the second operation position, that is, in the state where the power switch 91 is turned on. When the controller 94 determines Yes in step S10, the flow proceeds to step S6. As described above, the continuous firing can be performed when the push lever switch 93 is turned on within a predetermined time from the time when the timer 98 is started.

When the controller 94 determines No in step S7 or No in step S10, it performs the process of step S11. The process of step S11 is to move the position of the plunger 89 from the actuated position shown in FIG. 6B to the initial position shown in FIG. 6A. Namely, the controller 94 supplies power of the battery 96 to the solenoid 87 to move the plunger 89, and then shuts off the power supply to the solenoid 87. Also, the controller 94 resets the timer 98 in step S11.

When the controller 94 performs the process of step S11, the engaging portion 85 is released from the plunger 89. Therefore, the mode selection member 84 is actuated counterclockwise in FIG. 6A by the biasing force of the biasing member 86, and the mode selection member 84 returns to the first operation position and is stopped there. When the controller 94 performs the process of step S11, the driving mode of the driver 10 is switched from the continuous firing to the single firing.

Also, since the mode selection member 84 returns to the first operation position, the power switch 91 is turned off in step S12. Therefore, no power is supplied to the controller 94 and the controller 94 stops, and the control of FIG. 9 ends.

Note that, that, if the power switch 91 has a contact switch and a non-contact switch, it is also possible to perform the following process in step S12. That is, at the time when the contact switch is turned off by returning the mode selection member 84 to the first operation position, the controller 94 causes the display unit 101 to display for a predetermined period of time that the continuous firing has been switched to the single firing, and then turns off the non-contact switch to disconnect the electric circuit 138.

When the process of step S11 is performed in the state where the trigger 14 is held at the actuated position and the push lever 16 is separated from the workpiece 77, and the mode selection member 84 is switched from the second operation position to the first operation position, the support shaft 47 moves from the position shown in FIG. 5A to the position shown in FIG. 5B. Then, the arm 49 is actuated counterclockwise by the biasing force of the biasing member 81, and the arm 49 moves to the position outside the actuation range of the transmission member 75 as shown in FIG. 8D. Therefore, even if the push lever 16 is pressed to the workpiece 77 and the transmission member 75 is actuated from the initial position toward the actuated position, the actuation force of the transmission member 75 is not transmitted to the arm 49. Namely, the plunger 52 is held at the initial position, and the striking portion 13 does not perform the striking operation. Therefore, the single firing can be performed in the driver 10, but the continuous firing cannot be performed.

Further, when the controller 94 determines No in step S3, the flow proceeds to step S12. Namely, when the voltage of the battery 96 is equal to or lower than the specified value, the mode selection member 84 is held at the first operation position.

Figure 9:
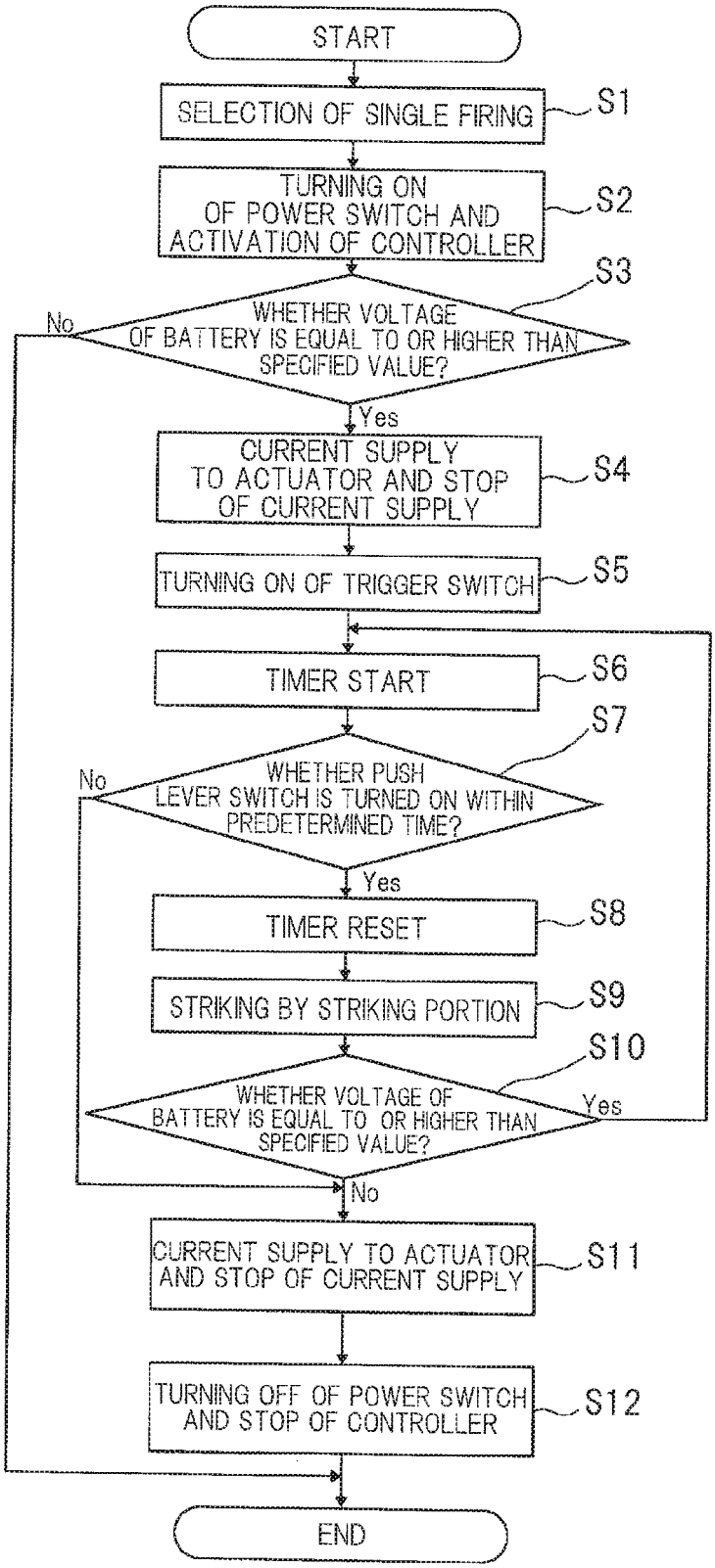
FIG. 9 is a flowchart including a control example performed when continuous firing is selected in the driver of FIG. 1.

In addition to the main routine shown in FIG. 9, the controller 94 constantly determines whether or not the voltage of the battery 96 is equal to or higher than the specified value as a subroutine. Namely, the time when the controller 94 determines whether or not the voltage of the battery 96 is equal to or higher than the specified value is not limited to that between step S2 and step S3 or in step S10. Then, if the mode selection member 84 is at the first operation position at the time when the controller 94 determines that the voltage of the battery 96 is not equal to or higher than the specified value, the controller 94 performs the control to maintain that state. Also, if the mode selection member 84 is at the second operation position at the time when the controller 94 determines that the voltage of the battery 96 is not equal to or higher than the specified value, the controller 94 performs the control to move the mode selection member 84 from the second operation position to the first operation position. Namely, the power switch 91 is turned off, and power supply to the controller 94 is stopped.

As described above, the controller 94 that is activated when the continuous firing is selected shuts off the power supply to the solenoid 87 for at least part of the period of time from when the mode selection member 84 is stopped at the second operation position in step S4 to when the mode selection member 84 is moved from the second operation position to the first operation position in step S11. The controller 94 may shut off the power supply to the solenoid 87 for the whole or part of the period of time from when the mode selection member 84 is stopped at the second operation position in step S4 to when the mode selection member 84 is moved from the second operation position to the first operation position in step S11. Therefore, the increase in the power consumption of the battery 96 can be suppressed. Accordingly, since it contributes to size reduction and weight saving of the battery 96, it is possible to achieve size reduction and weight saving of the entire product.

Second Embodiment

Figure 10A:
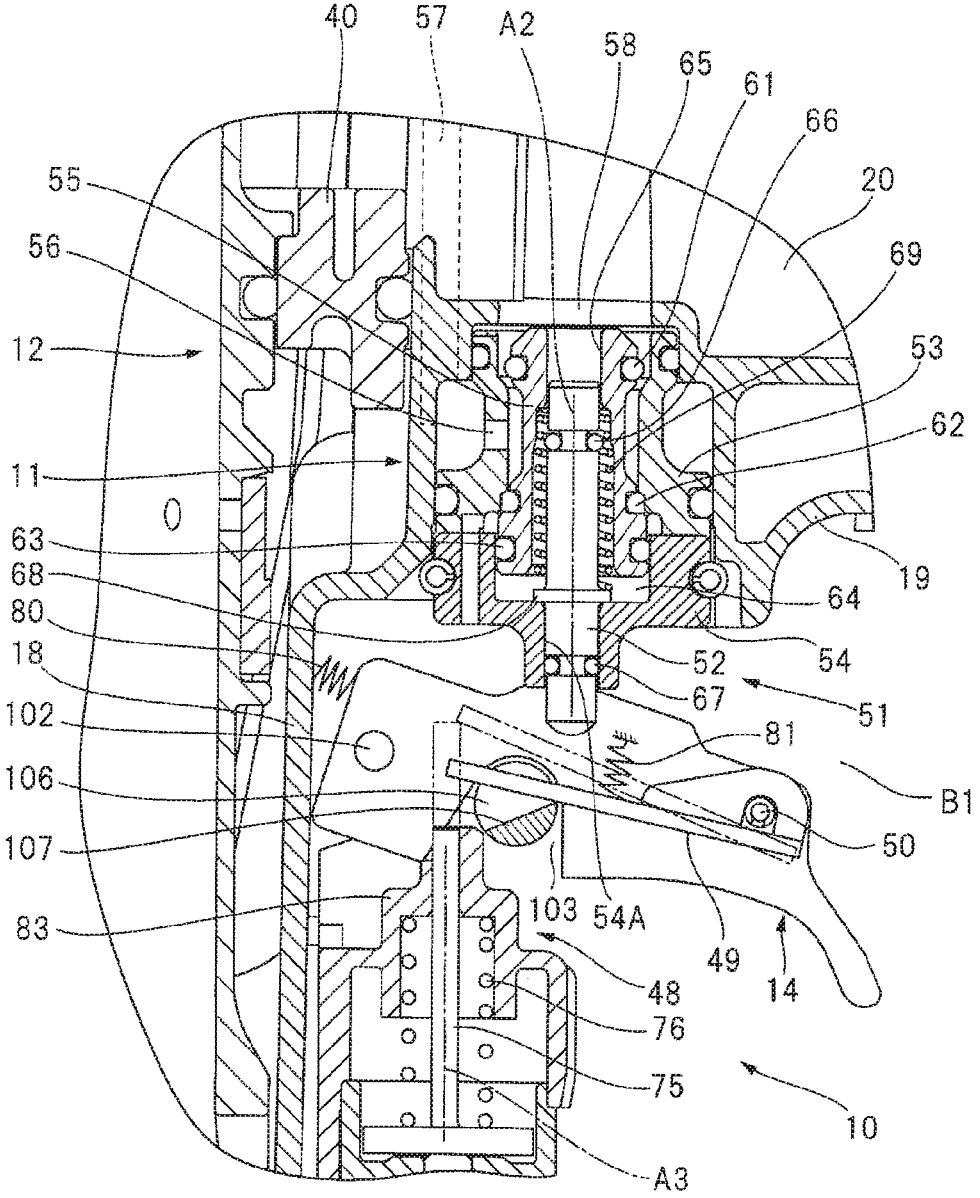
FIG. 10A is a partial cross-sectional view showing the state where single firing is selected and a trigger and a transmission member are at initial positions in a driver according to the second embodiment.
Figure 11A:
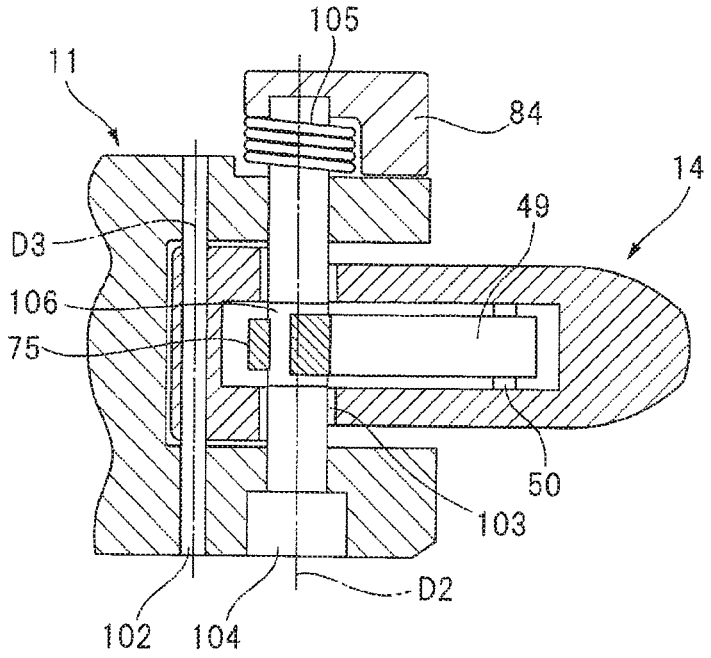
FIG. 11A is a bottom cross-sectional view showing the state where a switching lever is at a first operation position in the driver according to the second embodiment.

A driver according to the second embodiment will be described with reference to FIGS. 10A and 11A. In the driver according to the second embodiment, the same elements as those in the driver according to the first embodiment are designated by the same reference characters as those in the driver according to the first embodiment. The trigger 14 is attached to the main body 11 via a support shaft 102. The trigger 14 can be actuated about the support shaft 102 within the range of a predetermined angle in FIG. 10A, that is, can rotate in the clockwise direction and the counterclockwise direction. Note that the trigger 14 in the driver 10 according to the second embodiment is configured such that it can rotate about the support shaft 102 but does not revolve. A recess 103 formed by cutting out the outer edge of the trigger 14 is provided.

A support shaft 104 is provided in the main body 11. The support shaft 104 is disposed between the actuation range of the transmission member 75 and the support shaft 50 in the longitudinal direction of the trigger 14. At least a part of the support shaft 104 is located in the recess 103 when the trigger 14 is actuated about the support shaft 102 or when the trigger 14 is stopped. Therefore, the actuation of the trigger 14 is not hindered by the support shaft 104.

The support shaft 104 is rotatable about a center line D2. A biasing member 105 that biases the support shaft 104 clockwise in FIG. 10A is provided. The support shaft 104 has a cutout portion 106 and a connection portion 107. The cutout portion 106 is formed by denting a part of the support shaft 104 in the radial direction. The mode selection member 84 is attached to the support shaft 104.

The mode selection member 84 has the engaging portion 85 shown in FIG. 6A. Also, the solenoid 87 shown in FIG. 6 is provided in the main body 11 of FIG. 11A. The control system shown in FIG. 7 is also applied to the driver 10 according to the second embodiment. When the worker selects the single firing, the power switch 91 is turned off and no power is supplied to the controller 94. Namely, the controller 94 is stopped. The plunger 89 is released from the engaging portion 85, and the mode selection member 84 and the support shaft 104 are biased by the biasing force of the biasing member 105 and are stopped at the initial positions. FIGS. 10A and 11A show the state where the support shaft 104 is stopped at the initial position.

Figure 11B:
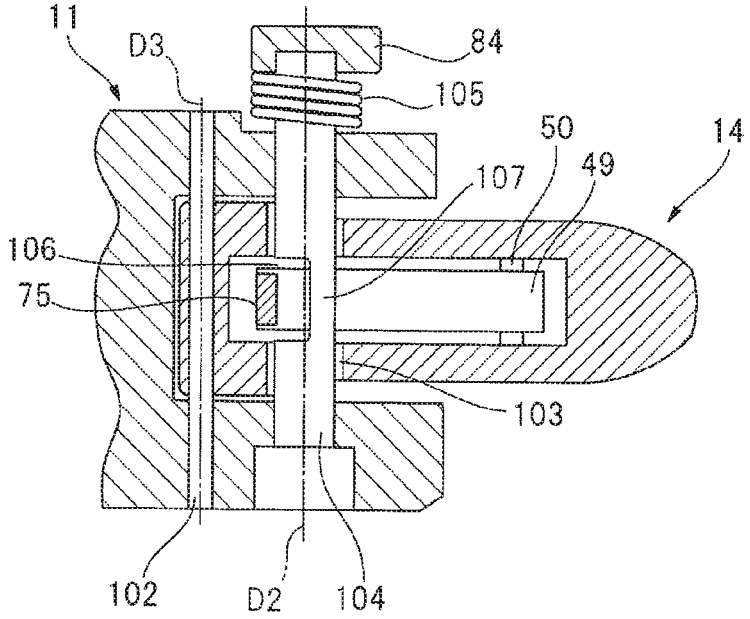
FIG. 11B is a bottom cross-sectional view showing the state where the switching lever is at a second operation position in the driver according to the second embodiment.

On the other hand, when the worker selects the continuous firing, the mode selection member 84 is actuated against the biasing force of the biasing member 105 and is moved to the second operation position. Then, the power switch 91 is turned on, so that power is supplied to the controller 94 and the controller 94 is activated. Further, the controller 94 supplies power to the solenoid 87, and the plunger 89 engages with the engaging portion 85. Therefore, the support shaft 104 is stopped at the actuated position shown in FIGS. 11B and 12A. When the support shaft 104 is stopped at the actuated position, the controller 94 shuts off the power to the solenoid 87 and the plunger 89 is stopped at the initial position.

An example of using the driver 10 according to the second embodiment will be described.

Example of Selecting Single Firing in Driver

The worker selects the single firing by stopping the mode selection member 84 at the first operation position. As shown by the solid line in FIG. 10A, when the trigger 14 is stopped at the initial position and the transmission member 75 is stopped at the initial position, the arm 49 comes into contact with the connection portion 107 and is stopped at the initial position. A part of the arm 49 is located inside the cutout portion 106. The arm 49 is separated from the plunger 52, and the plunger 52 is stopped at the initial position. The trigger valve 51 connects the pressure accumulation chamber 20 and the passage 56 and disconnects the passage 56 and the passage 60. The head valve 31 closes the port 33, and the striking portion 13 is stopped at the top dead center.

When the push lever 16 is pressed to the workpiece 77, the transmission member 75 moves from the initial position indicated by the solid line to the actuated position indicated by the two-dot chain line. The actuation force of the transmission member 75 is transmitted to the arm 49, and the arm 49 moves from the initial position indicated by the solid line to the actuated position indicated by the two-dot chain line. At this time, since the operation force is not applied to the trigger 14, the actuation force of the arm 49 is not transmitted to the plunger 52 and the plunger 52 is stopped at the initial position.

Figure 10B:
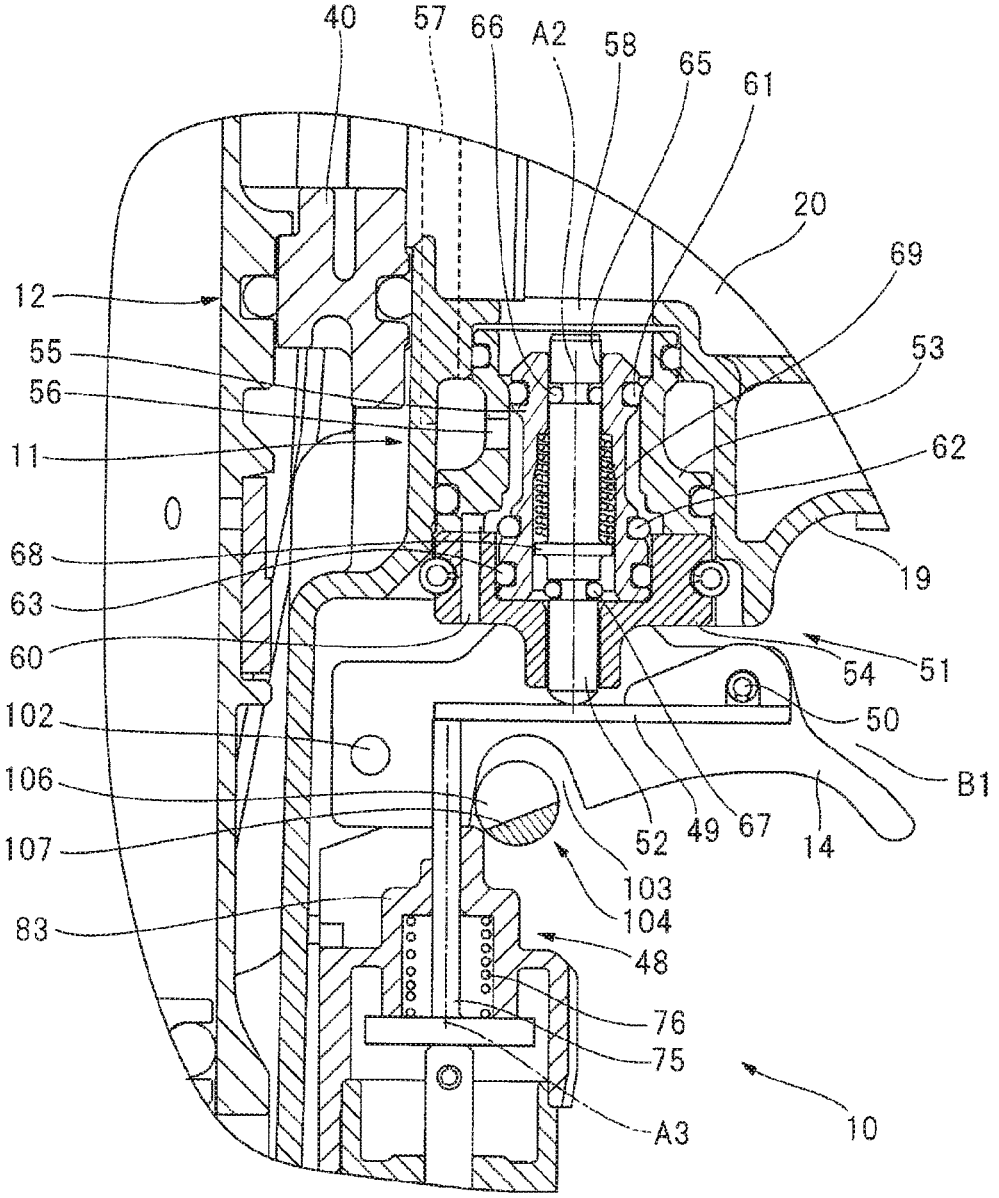
FIG. 10B is a partial cross-sectional view showing the state where the single firing is selected and the trigger and the transmission member are at actuated positions in the driver according to the second embodiment.

The worker applies the operation force to the trigger 14 in the state where the transmission member 75 is stopped at the actuated position, thereby moving the trigger 14 to the actuated position as shown in FIG. 10B. Then, the actuation force of the arm 49 is transmitted to the plunger 52, and the plunger 52 moves to the actuated position and is stopped there. The trigger valve 51 disconnects the pressure accumulation chamber 20 and the passage 56, and connects the passage 56 and the passage 60. The head valve 31 opens the port 33, and the striking portion 13 is actuated from the top dead center toward the bottom dead center.

Figure 10C:
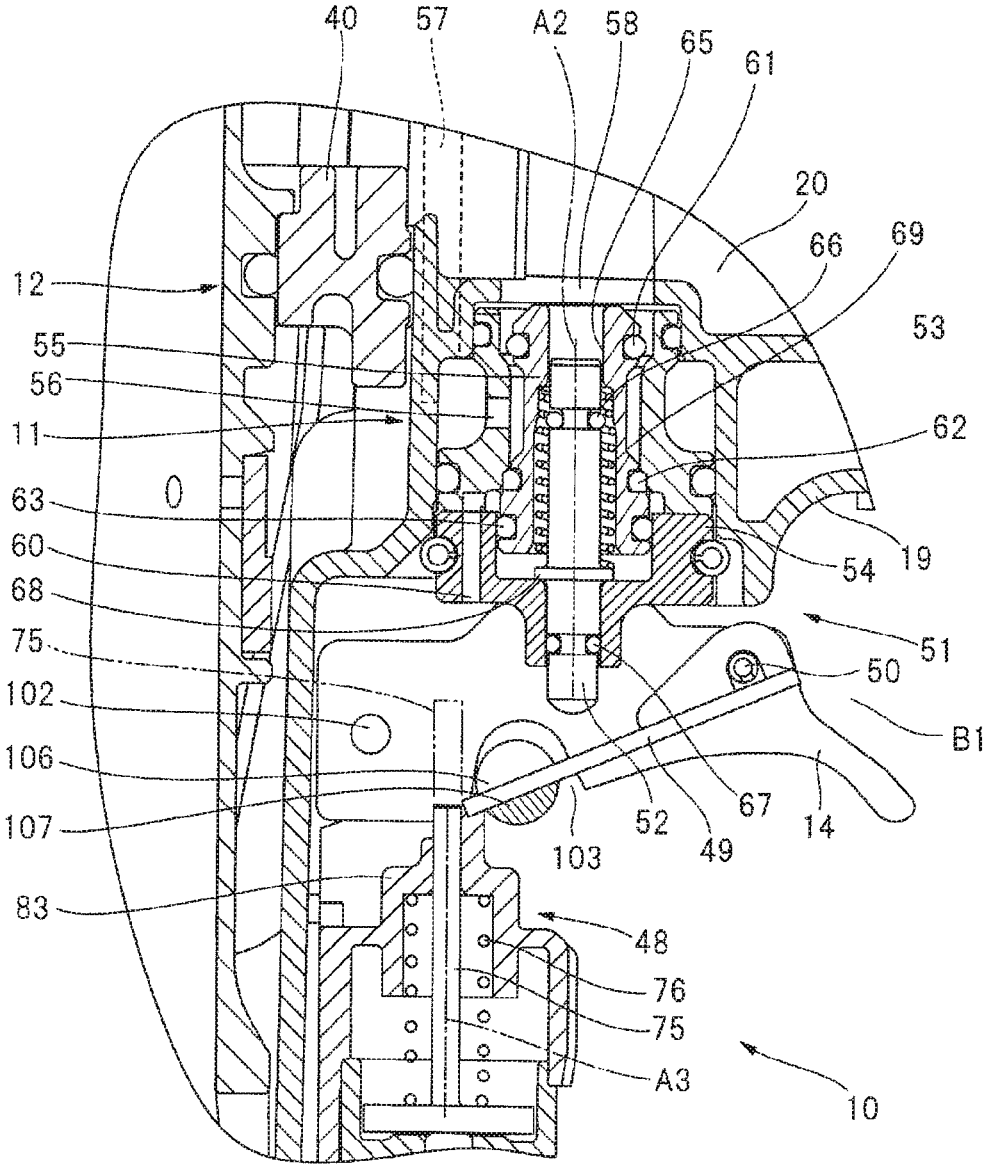
FIG. 10C is a partial cross-sectional view showing the state where the single firing is selected, the trigger is at the actuated position, and the transmission member is at the initial position in the driver according to the second embodiment.

When the worker separates the push lever 16 from the workpiece 77 in the state where the trigger 14 is being held at the actuated position, the transmission member 75 moves from the actuated position indicated by the two-dot chain line in FIG. 10C to the initial position indicated by the solid line. Also, the arm 49 is actuated by the biasing force of the biasing member 81 and is stopped at the initial position indicated by the solid line. Further, the plunger 52 returns from the actuated position to the initial position and is stopped there.

The arm 49 is stopped at the position outside the actuation range of the transmission member 75. Therefore, even if the worker presses the push lever 16 to the workpiece 77 to move the transmission member 75 from the initial position to the actuated position in the state where the trigger 14 is being held at the actuated position, the actuation force of the transmission member 75 is not transmitted to the arm 49. Therefore, the plunger 52 is stopped at the initial position.

Example of Selecting Continuous Firing in Driver

The worker selects the continuous firing by stopping the mode selection member 84 at the second operation position. The support shaft 104 is switched from the initial position shown in FIGS. 10A and 11A to the actuated position shown in FIGS. 12A and 11A. Further, the power switch 91 is turned on and the controller 94 is activated. The controller 94 supplies power to the solenoid 87, and shuts off the power supply to the solenoid 87 after the support shaft 104 is held at the actuated position.

Figure 12A:
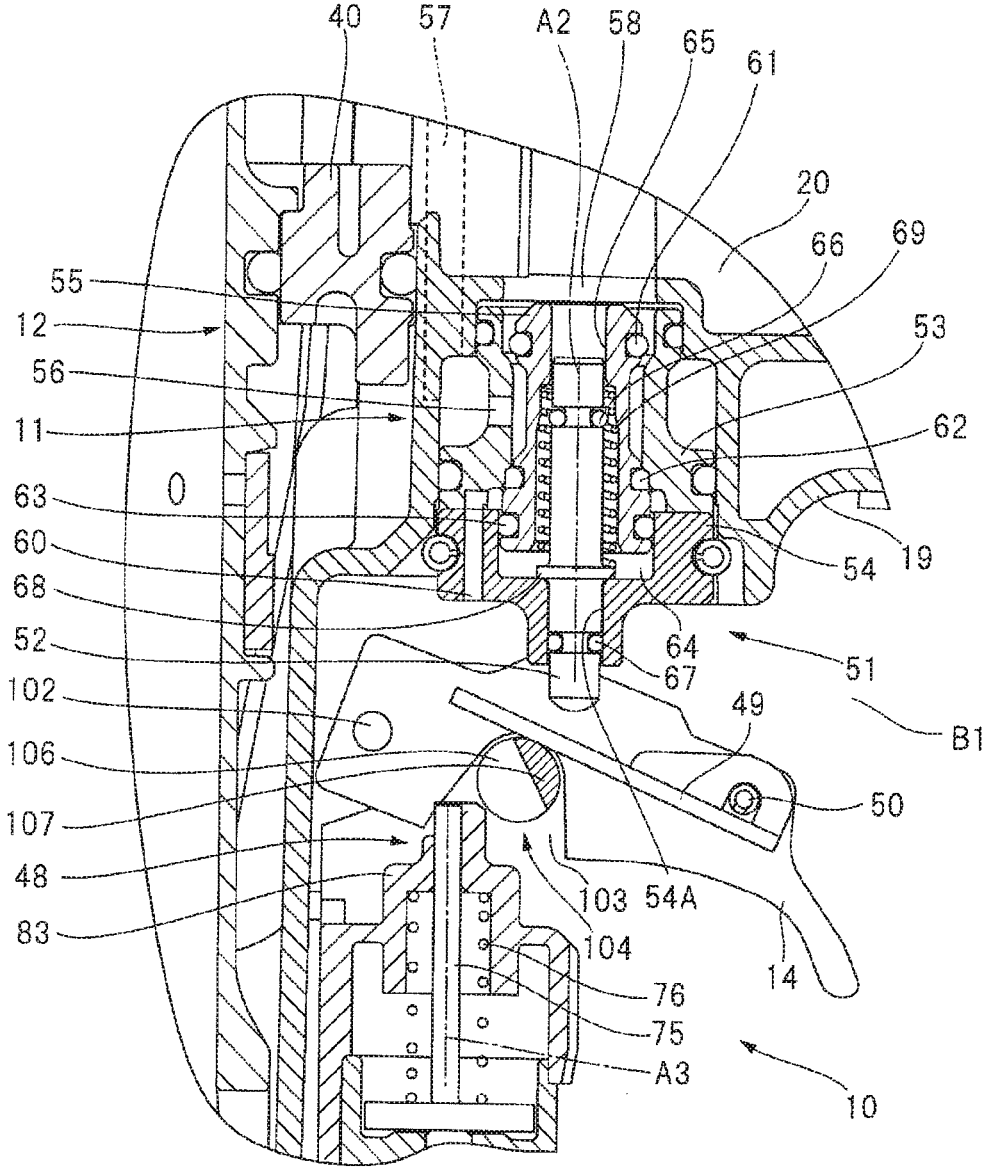
FIG. 12A is a partial cross-sectional view showing the state where continuous firing is selected and the trigger and the transmission member are at the initial positions in the driver according to the second embodiment.

As shown in FIG. 12A, when the trigger 14 is stopped at the initial position and the transmission member 75 is stopped at the initial position, the entire arm 49 is located outside the cutout portion 106 and is stopped at the initial position in contact with the connection portion. The arm 49 is separated from the plunger 52, and the plunger 52 is stopped at the initial position. The trigger valve 51 connects the pressure accumulation chamber 20 and the passage 56 and disconnects the passage 56 and the passage 60. The head valve 31 closes the port 33, and the striking portion 13 is stopped at the top dead center.

Figure 12B:
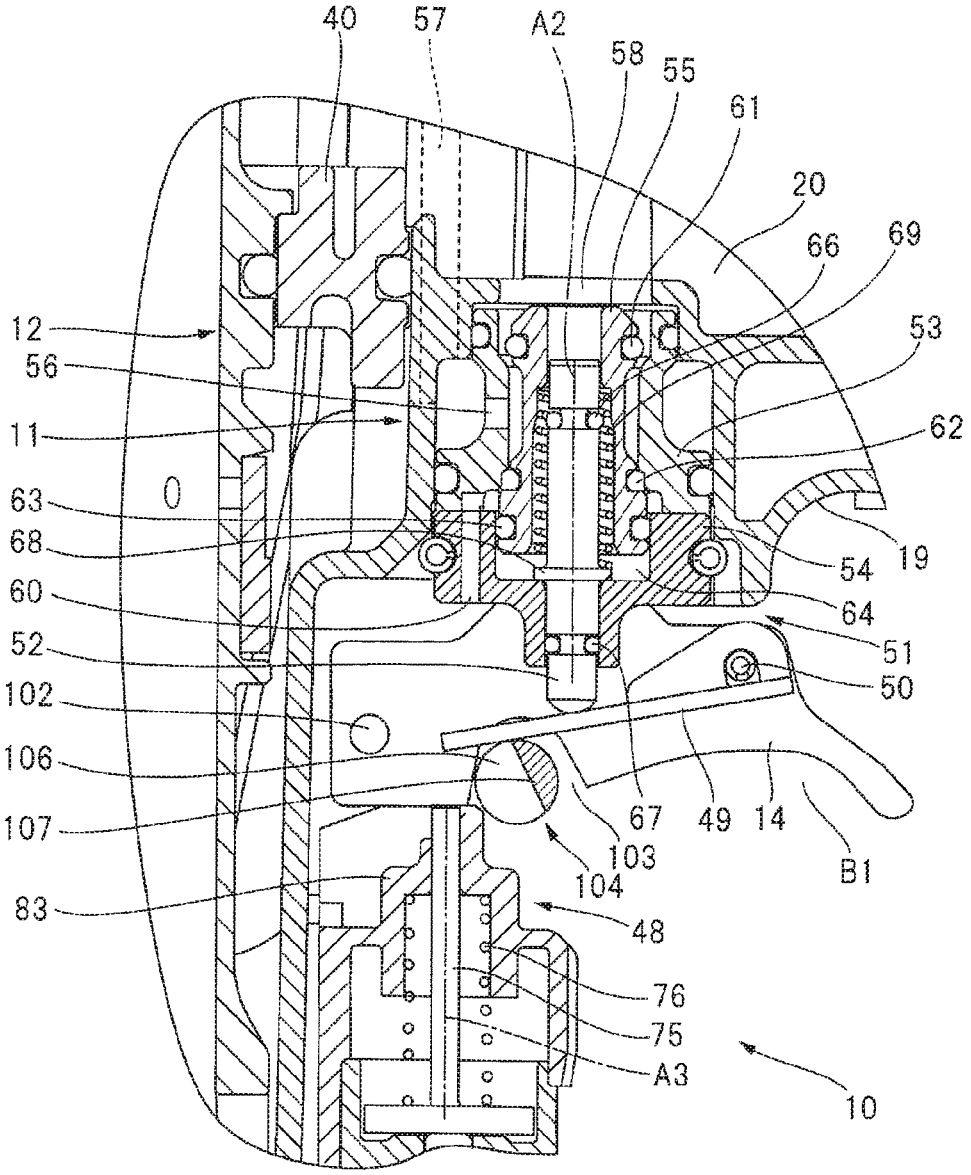
FIG. 12B is a partial cross-sectional view showing the state where the continuous firing is selected, the trigger is at the actuated position, and the transmission member is at the initial position in the driver according to the second embodiment.

Even when the worker applies an operation force to the trigger 14 to actuate the trigger 14 from the initial position to the actuated position as shown in FIG. 12B, the actuation force of the arm 49 is not transmitted to the plunger 52 if the push lever 16 is separated from the workpiece 77. The plunger 52 is stopped at the initial position.

Figure 12C:
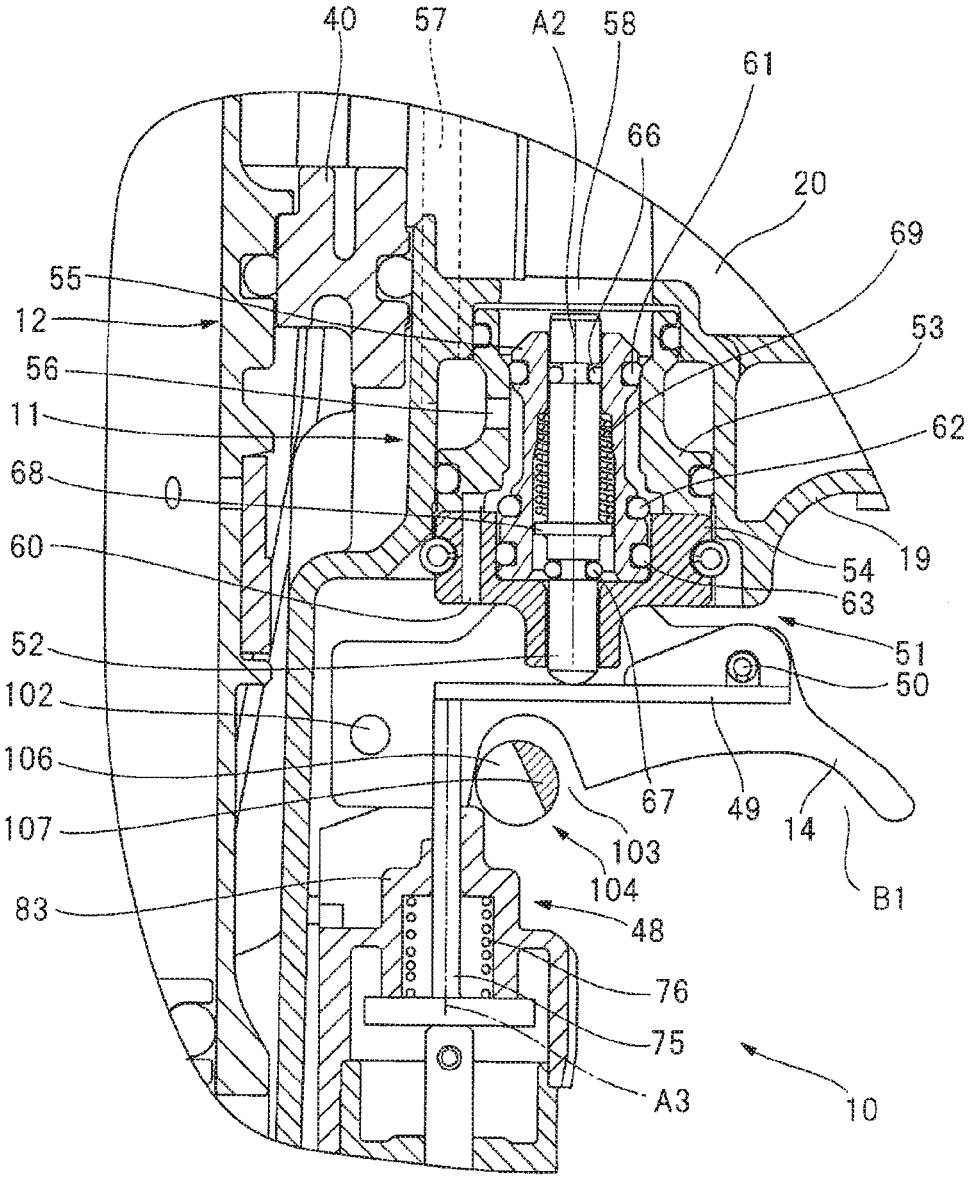
FIG. 12C is a partial cross-sectional view showing the state where the continuous firing is selected, the trigger is at the actuated position, and the transmission member is at the actuated position in the driver according to the second embodiment.

When the worker presses the push lever 16 to the workpiece 77 in the state where the operation force is applied to the trigger 14, the transmission member 75 moves to the actuated position as shown in FIG. 12C. The actuation force of the transmission member 75 is transmitted to the arm 49, the arm 49 is separated from the connection portion 107, and the actuation force of the arm 49 is transmitted to the plunger 52. The plunger 52 moves from the initial position to the actuated position and is stopped there. Therefore, the head valve 31 opens the port 33, and the striking portion 13 is actuated from the top dead center toward the bottom dead center.

When the worker separates the push lever 16 from the workpiece 77 in the state where the trigger 14 is being held at the actuated position, the transmission member 75 moves to the initial position shown in FIG. 12B. Therefore, the arm 49 is actuated counterclockwise by the biasing force of the biasing member 81, comes into contact with the connection portion 107, and is stopped there. The plunger 52 returns from the actuated position to the initial position and is stopped there. A part of the arm 49 is located within the actuation range of the transmission member 75.

Therefore, when the worker presses the push lever 16 to the workpiece 77 to move the transmission member 75 from the initial position to the actuated position in the state where the trigger 14 is being held at the actuated position as shown in FIG. 12C, the actuation force of the transmission member 75 is transmitted to the plunger 52 through the arm 49, and the plunger 52 is actuated from the initial position to the actuated position and is stopped there. In this manner, it is possible to perform the continuous firing in the driver 10.

The driver according to the second embodiment can perform the control example of FIG. 9. The controller 94 starts the timer 98 in step S6. When the controller 94 determines Yes in step S7, the flow proceeds to step S8. Namely, the support shaft 104 is held at the actuated position shown in FIGS. 11B and 12C in the actuation direction about the center line D2.

On the other hand, when the controller 94 determines No in step S7, the flow proceeds to step S11. Therefore, the support shaft 104 is actuated clockwise in FIG. 12B by the biasing force of the biasing member 105 and is stopped at the initial position shown in FIGS. 10C and 11A. Namely, the entire arm 49 is located outside the actuation range of the transmission member 75, and the arm 49 is stopped. Therefore, even if the push lever 16 is pressed to the workpiece 77 in the state where the trigger 14 is located at the actuated position, the actuation force of the transmission member 75 is not transmitted to the plunger 52. Namely, it is not possible to perform the continuous firing.

The other processes and determinations in each step when performing the control example of FIG. 9 in the driver 10 according to the second embodiment are the same as the processes and determinations in each step when performing the control example of FIG. 9 in the driver 10 according to the first embodiment.

In the driver 10 according to the second embodiment, the controller 94 that is activated when the continuous firing is selected shuts off the power supply to the solenoid 87 for at least part of the period of time from when the mode selection member 84 is stopped at the second operation position in step S4 to when the mode selection member 84 is moved from the second operation position to the first operation position in step S11. Therefore, the driver 10 according to the second embodiment can obtain the same effect as that of the driver 10 according to the first embodiment.

Third Embodiment

Figure 13:
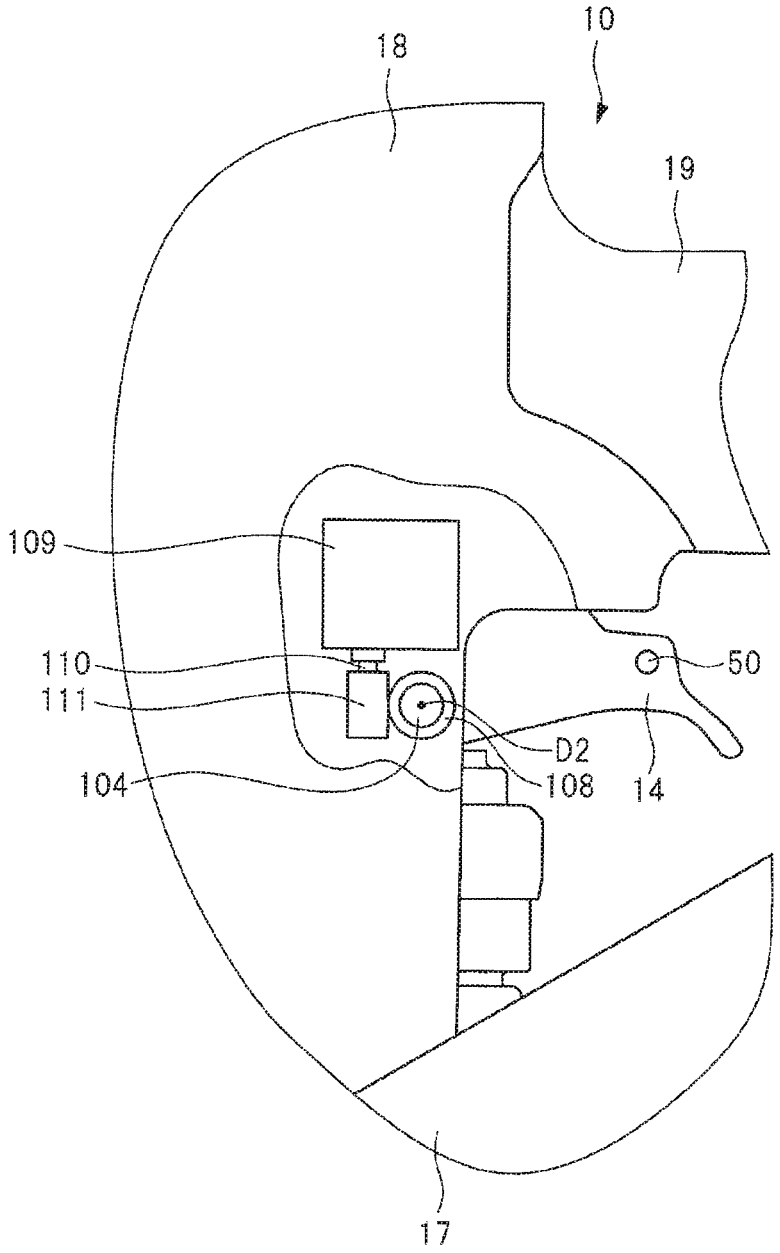
FIG. 13 is a partial schematic diagram showing a driver according to the third embodiment.
Figure 14A:
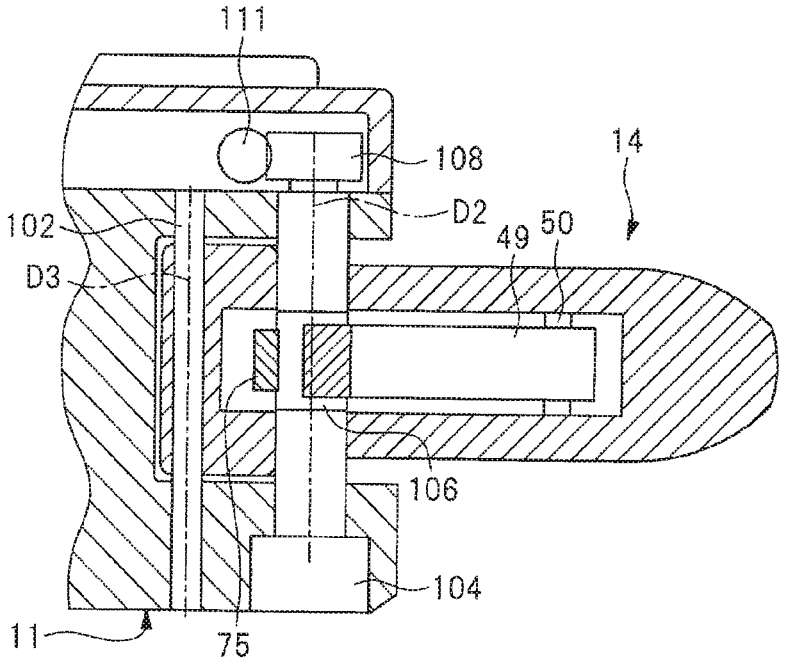
FIG. 14A is a bottom cross-sectional view showing the state where a support shaft is at an initial position in the driver according to the third embodiment.
Figure 14B:
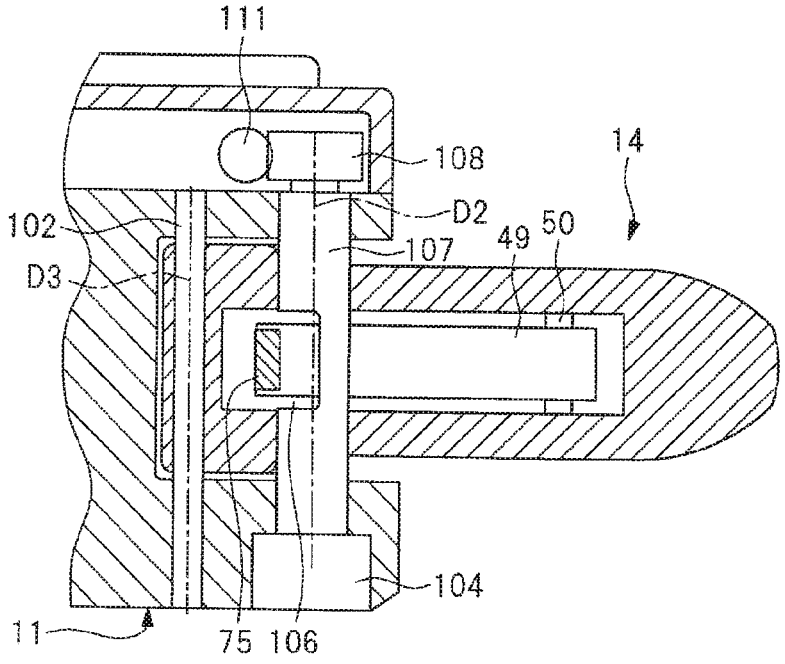
FIG. 14B is a bottom cross-sectional view showing the state where the support shaft is at an actuated position in the driver according to the third embodiment.

A driver according to the third embodiment will be described with reference to FIGS. 13, 14A, and 14B. In the driver 10 according to the third embodiment, the same components as those in the drivers 10 according to the first and second embodiments are designated by the same reference characters as those in the drivers 10 according to the first and second embodiments. The support shaft 104 has the cutout portion 106 and the connection portion 107. Also, a worm wheel 108 is provided on the support shaft 104. The trigger 14 is configured such that it spins or rotates about the support shaft 102 but does not revolve. Further, a servo motor 109 is provided in the main body 11, and a worm 111 is formed on a rotary shaft 110 of the servo motor 109. The worm 111 meshes with the worm wheel 108. The mode selection member 84 and the biasing member 105 are omitted in FIGS. 14A and 14B.

Further, the control system of FIG. 7 is also applicable to the driver 10 according to the third embodiment. The servo motor 109 corresponds to the actuator 112. Also, the controller 94 can perform the control to supply a current from the battery 96 to the servo motor 109 and the control to stop the supply of current to the servo motor 109. Further, the controller 94 performs the control to change the direction of the current flowing through the servo motor 109. Namely, the controller 94 controls the rotation, rotation direction, and stop of the rotary shaft 110 of the servo motor 109. The rotation direction of the rotary shaft 110 of the servo motor 109 can be switched between forward and reverse.

The functions of the trigger 14, the transmission member 75, the arm 49, and the plunger 52 in the driver 10 according to the third embodiment are the same as the functions of the trigger 14, the transmission member 75, the arm 49, and the plunger 52 in the drivers 10 according to the first and second embodiments.

When the single firing is selected in the driver 10 according to the third embodiment, no power is supplied to the controller 94. Also, the rotary shaft 110 of the servo motor 109 is stopped at the initial position. Further, the power supply to the servo motor 109 is stopped. The support shaft 104 is stopped at the initial position shown in FIG. 14A.

The driver 10 according to the third embodiment can perform the control example of FIG. 9 when the continuous firing is selected. The controller 94 causes the rotary shaft 110 of the servo motor 109 to rotate forward and stop at the actuated position in step S4. Then, the support shaft 104 is stopped at the actuated position shown in FIG. 14B. Further, the controller 94 stops the supply of current to the servo motor 109 after stopping the rotary shaft 110 of the servo motor 109 at the actuated position.

The controller 94 stops the supply of current to the servo motor 109 after reversely rotating the rotary shaft 110 of the servo motor 109 and stopping it at the initial position in step S11. Then, the support shaft 104 is stopped at the initial position shown in FIG. 14A, and the flow proceeds to step S12. The other processes and determinations in each step when performing the control example of FIG. 9 in the driver 10 according to the third embodiment are the same as the processes and determinations in each step when performing the control example of FIG. 9 in the driver 10 according to the first embodiment.

In the driver 10 according to the third embodiment, the controller 94 that is activated when the continuous firing is selected shuts off the power supply to the servo motor 109 for at least part of the period of time from when the mode selection member 84 is stopped at the second operation position in step S4 to when the mode selection member 84 is moved from the second operation position to the first operation position in step S11. Therefore, the driver 10 according to the third embodiment can obtain the same effect as that of the driver 10 according to the first embodiment.

Fourth Embodiment

A driver according to the fourth embodiment will be described with reference to FIGS. 5A, 5B, 15A, 15B, and 15C. In the driver 10 according to the fourth embodiment, the same components as those in the drivers 10 according to the first and third embodiments are designated by the same reference characters as those in the drivers 10 according to the first and third embodiments. As shown in FIGS. 5A and 5B, the trigger 14 can rotate and revolve about the support shaft 47. Further, although the mode selection member 84 is provided, the biasing member 86 and the solenoid 87 shown in FIG. 6A are not provided. Namely, the mode selection member 84 is actuated and stopped only by the operation force of the worker.

A solenoid 113 is provided in the main body 11. The solenoid 113 is a keep solenoid having a coil 114, a plunger 115, and a ring-shaped permanent magnet 116. The plunger 115 is made of, for example, a magnetic material such as iron or steel. When a current flows through the coil 114 in the solenoid 113, the plunger 115 is actuated in the axial direction against the attractive force of the permanent magnet 116. When the controller 94 switches the direction of the current supplied to the coil 114, the direction in which the plunger 115 is actuated can be changed. When the controller 94 shuts off the power supply to the coil 114, the plunger 115 is stopped at a predetermined axial position by the attractive force of the permanent magnet 116. The plunger 115 is stopped at either the initial position shown in FIGS. 15A and 15B or the actuated position shown in FIG. 15C.

The driver 10 according to the fourth embodiment has a part of the control system shown in FIG. 7. The power switch 91 in the driver 10 according to the fourth embodiment only has a function of outputting a signal for detecting the position of the mode selection member 84, and does not have a function of connecting and disconnecting the electric circuit 138. Namely, regardless of whether the single firing mode or the continuous firing mode is selected, the power of the battery 96 is supplied to the controller 94 and the controller 94 is activated.

The solenoid 113 corresponds to the actuator 112. The controller 94 can control supply and stop of current to the coil 114. Further, the controller 94 can switch the direction in which the current is supplied to the coil 114. The plunger 115 is actuated in the forward direction and the reverse direction in accordance with the direction in which the current is supplied to the coil 114.

Figure 15A:
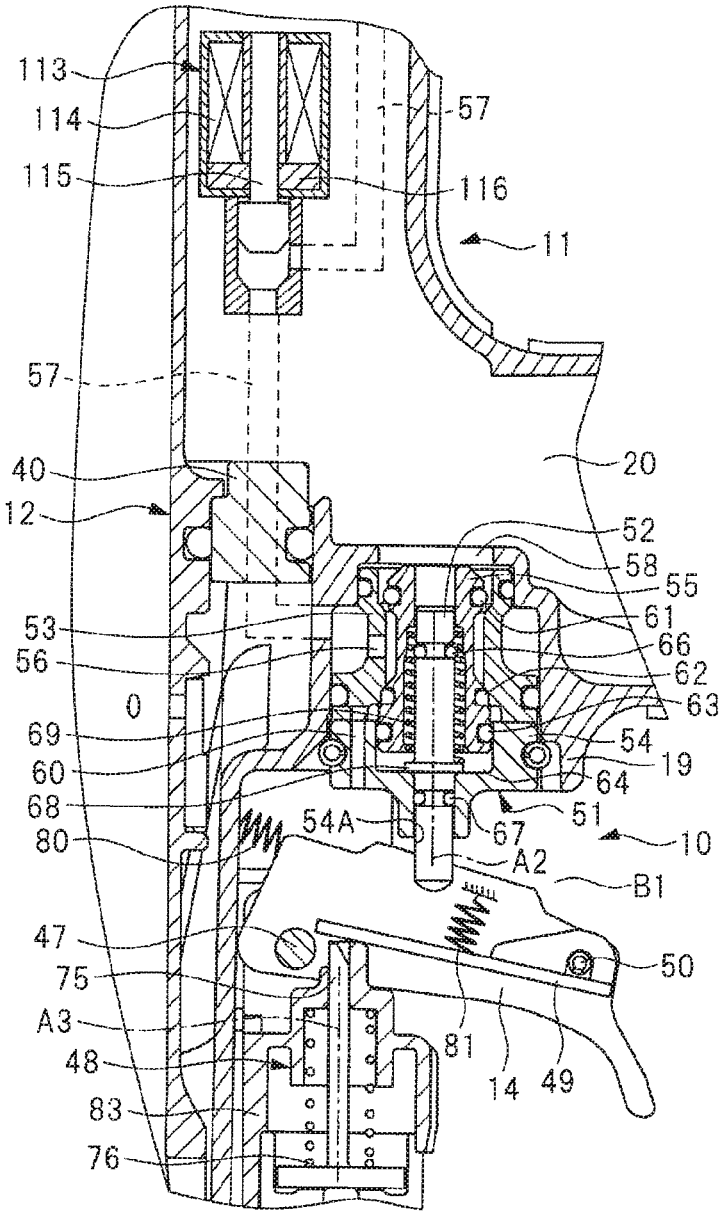
FIG. 15A is a cross-sectional view of a driver according to the fourth embodiment, showing the state where a solenoid opens a passage and a trigger and a transmission member are at initial positions.
Figure 15B:
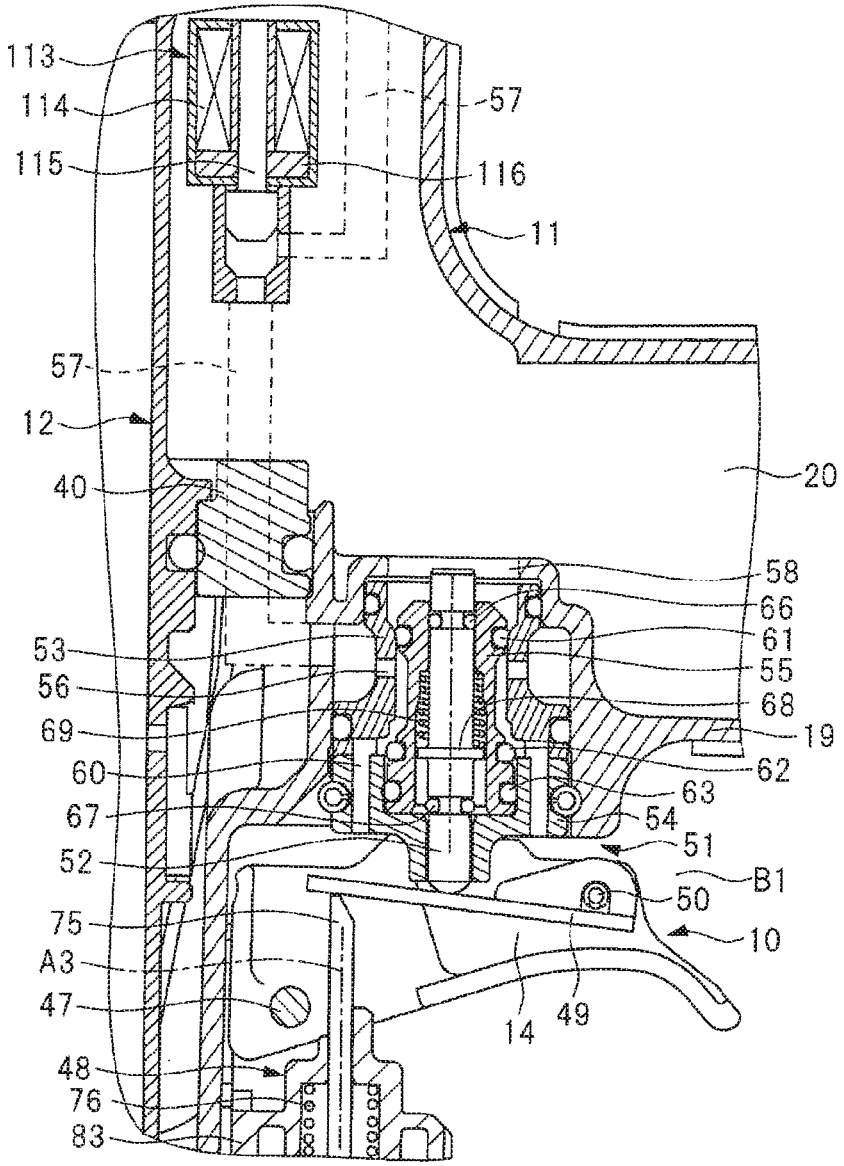
FIG. 15B is a cross-sectional view of the driver according to the fourth embodiment, showing the state where the solenoid opens the passage and the trigger and the transmission member are at actuated positions.
Figure 15C:
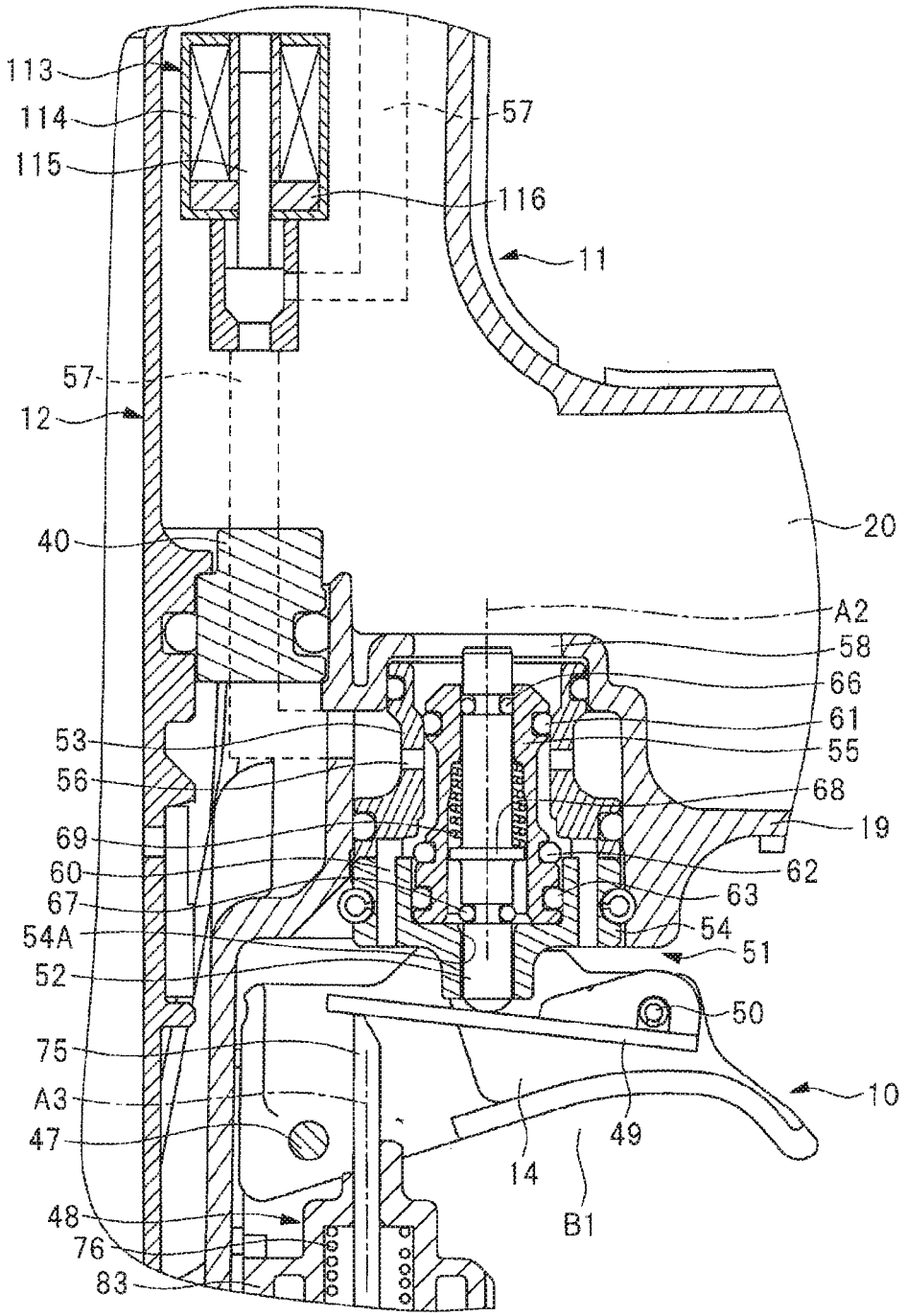
FIG. 15C is a cross-sectional view of the driver according to the fourth embodiment, showing the state where the solenoid closes the passage and the trigger and the transmission member are at the actuated positions.

As shown in FIGS. 15A and 15B, when the plunger 115 is stopped at the initial position, the plunger 115 opens the passage 57. As shown in FIG. 15C, when the plunger 115 is stopped at the actuated position, the plunger 115 closes the passage 57. The solenoid 113 is a valve that opens and closes the passage 57.

Further, power is not transmitted between the mode selection member 84 and at least one of the trigger 14 and the arm 49.

A control example performed in the driver 10 according to the fourth embodiment will be described with reference to the flowchart of FIG. 16. The controller 94 determines whether the continuous firing is selected in step S21. When the controller 94 determines Yes in step S21, it causes the solenoid 113 to close the passage 57 and stops the power supply to the solenoid 113 in step S22. The controller 94 determines whether the trigger switch 92 is turned on in step S23. When the controller 94 determines No in step S23, the flow proceeds to step S22. When the controller 94 determines Yes in step S23, it supplies power to the solenoid 113 and causes the solenoid 113 to open the passage 57, and stops the power supply to the solenoid 113 in step S24.

In step S25, the controller 94 starts the timer 98 when the trigger switch 92 is turned on. The order of performing the processes of steps S25 and S26 does not matter, and the processes of steps S25 and S26 may be performed simultaneously. After starting the timer 98, the controller 94 makes the determination in step S26. The determination in step S26 is whether the push lever switch 93 is turned on within a predetermined time from the time when the timer 98 is started.

When the controller 94 determines Yes in step S26, it resets the timer 98 in step S27. Further, the push lever 16 is pressed to the workpiece 77, and the striking portion 13 drives the nail 73 in step S28.

Note that, in step S24, at the time when the power supply to the solenoid 113 is stopped, the trigger switch 92 is turned on and then the push lever switch 93 is turned on, the control to open the passage 57 may be performed by supplying power to the solenoid 113.

In step S29, the controller 94 determines whether the voltage of the battery 96 is equal to or higher than a specified value. When the controller 94 determines Yes in step S29, it determines in step S30 whether the trigger switch 92 is off. When the controller 94 determines No in step S30, the flow proceeds to step S25.

Figure 16:
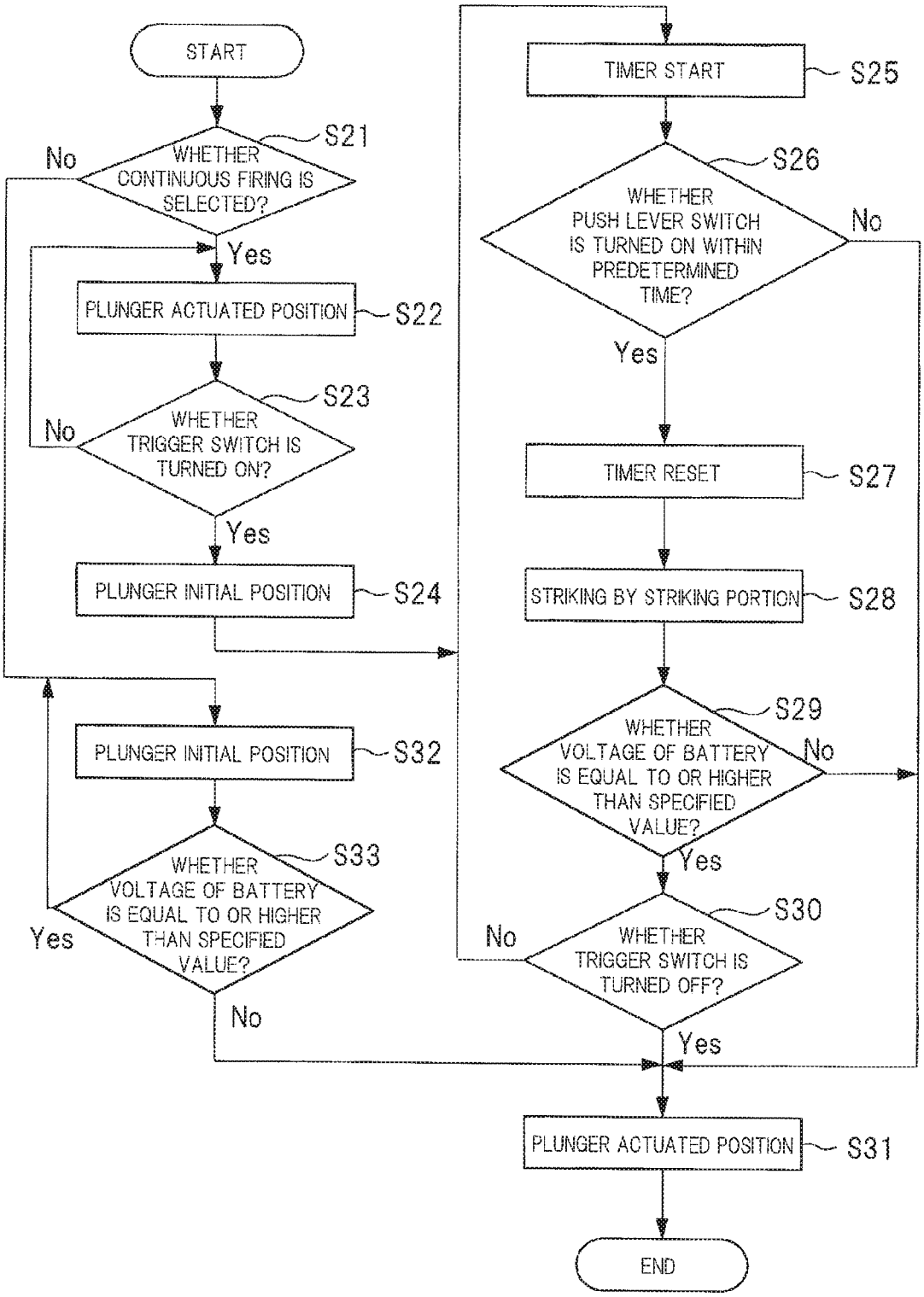
FIG. 16 is a flowchart including a control example performed when continuous firing is selected in the drivers according to the fourth, fifth, and sixth embodiments.

When the controller 94 determines Yes in step S30, it supplies power to the solenoid 113 to cause the solenoid 113 to close the passage 57 in step S31, and then stops the power supply to the solenoid 113, and the control example of FIG. 16 ends. When the controller 94 determines No in step S26 or determines No in step S29, the flow proceeds to step S31.

When the controller 94 determines No in step S21, it supplies power to the solenoid 113 in step S32 to cause the solenoid 113 to open the passage 57, and then stops the power supply to the solenoid 113. By the process of step S32, the driver 10 can perform the single firing. When the single firing is selected, the actuation of the trigger 14, the actuation of the transmission member 75, the actuation of the arm 49, and the actuation of the plunger 52 are the same as those in the driver 10 according to the first embodiment.

Further, the controller 94 determines in step S33 subsequent to step S32 whether the voltage of the battery 96 is equal to or higher than a specified value. When the controller 94 determines Yes in step S33, the flow proceeds to step S32. When the controller 94 determines No in step S33, the flow proceeds to step S31.

When the controller 94 determines No in step S26 and the flow proceeds to step S31, determines No in step S29 and the flow proceeds to step S31, or determines No in step S33 and the flow proceeds to step S31, the controller 94 may cause the display unit 101 to display that the driver 10 cannot perform the driving.

Note that the controller 94 can constantly determine whether or not the voltage of the battery 96 is equal to or higher than the specified value. Namely, the time when the controller 94 determines whether or not the voltage of the battery 96 is equal to or higher than the specified value is not limited to that between step S28 and step S30 or in step S33. Then, when the controller 94 determines that the voltage of the battery 96 is not equal to or higher than the specified value, the flow proceeds to step S31.

As described above, the controller 94 stops the supply of current to the solenoid 113 for at least part of the period of time from when the timer 98 is started in step S25 to when the predetermined time elapses. Therefore, the driver 10 according to the fourth embodiment can obtain the same effect as that of the driver 10 according to the first embodiment.

Fifth Embodiment

A driver according to the fifth embodiment will be described with reference to FIGS. 5A, 5B, 17A, 17B, and 17C. In the driver 10 according to the fifth embodiment, the same components as those in the drivers 10 according to the first and fourth embodiments are designated by the same reference characters as those in the drivers 10 according to the first and fourth embodiments. As shown in FIGS. 5A and 5B, the trigger 14 can rotate and revolve about the support shaft 47. Further, although the mode selection member 84 is provided, the biasing member 86 and the solenoid 87 shown in FIG. 6A are not provided. Namely, the mode selection member 84 is actuated and stopped only by the operation force of the worker.

A solenoid 125 is provided in the main body 11, for example, in the handle 19. The solenoid 125 is a keep solenoid having a coil 126, a plunger 127, and a ring-shaped permanent magnet 117. The plunger 127 is made of, for example, a magnetic material such as iron or steel. When a current flows through the coil 126 in the solenoid 127, the plunger 127 is actuated in the axial direction against the attractive force of the permanent magnet 117. When the controller 94 switches the direction of the current supplied to the coil 126, the direction in which the plunger 127 is actuated can be changed. When the controller 94 shuts off the power supply to the coil 126, the plunger 127 is stopped at a predetermined axial position by the attractive force of the permanent magnet 117. The plunger 127 is stopped at either the initial position shown in FIGS. 17A and 17B or the actuated position shown in FIG. 17C.

Further, the first body 53 has a shaft hole 128, and a part of the plunger 127 is disposed in the shaft hole 128. A sealing member 129 is attached to the first body 53. The sealing member 129 has an annular shape and is made of synthetic rubber. The sealing member 129 is in contact with the outer peripheral surface of the plunger 127, and the sealing member 129 hermetically seals between the inner peripheral surface of the shaft hole 128 and the outer peripheral surface of the plunger 127. An annular engaging portion 130 is provided on the outer peripheral surface of the valve body 55. The engaging portion 130 is an end surface perpendicular to the center line A2. When the valve body 55 is actuated in the direction of the center line A2, the engaging portion 130 moves in the direction of the center line A2.

The driver 10 according to the fifth embodiment has the control system shown in FIG. 7. The solenoid 125 corresponds to the actuator 112. The controller 94 can control supply and stop of current to the solenoid 125. Further, the controller 94 can switch the direction in which the current is supplied to the solenoid 125. The plunger 127 is actuated in the forward direction and the reverse direction in accordance with the direction in which the current is supplied to the solenoid 125. When the supply of current to the solenoid 125 is stopped, the plunger 127 is stopped at a predetermined axial position by the attractive force of the permanent magnet 117.

Figure 17A:
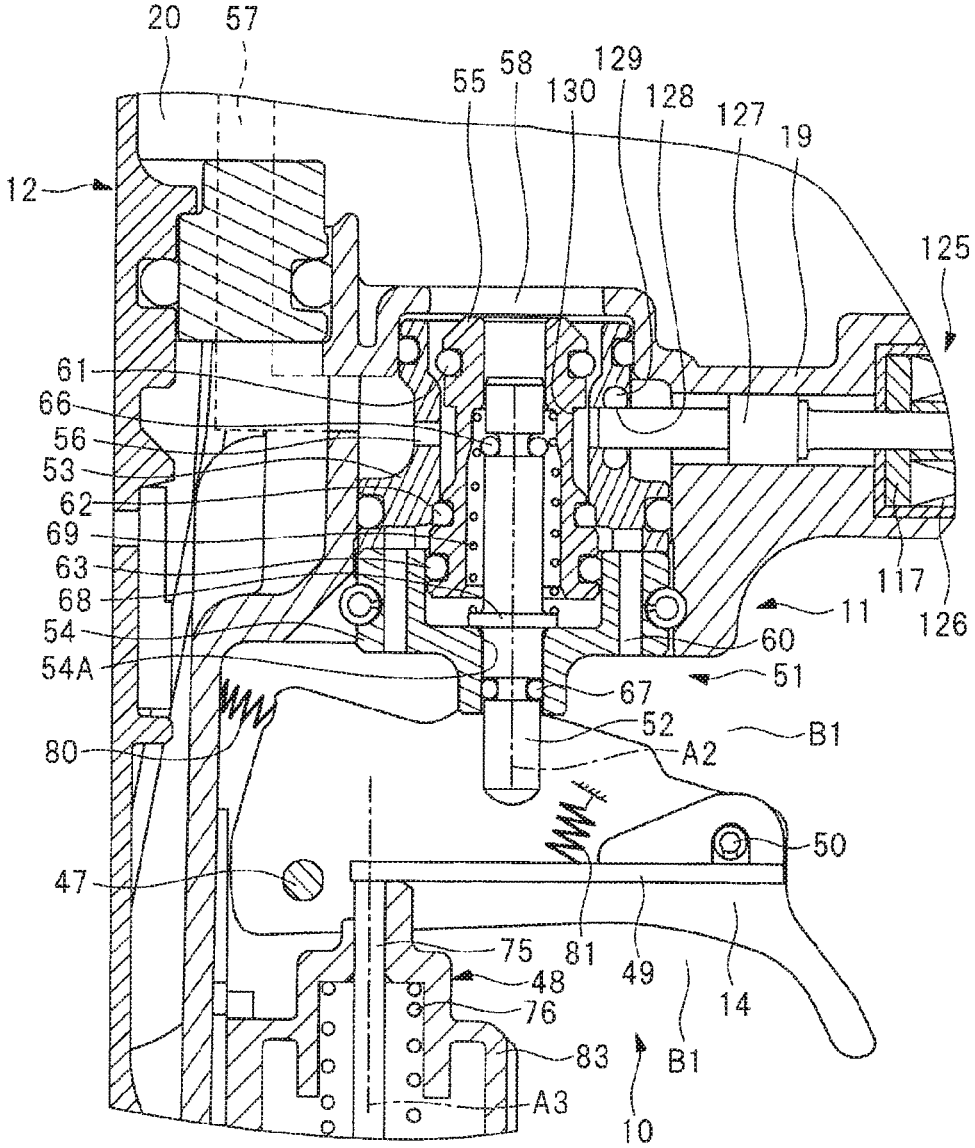
FIG. 17A is a cross-sectional view of a driver according to the fifth embodiment, showing the state where a trigger and a transmission member are at initial positions.
Figure 17B:
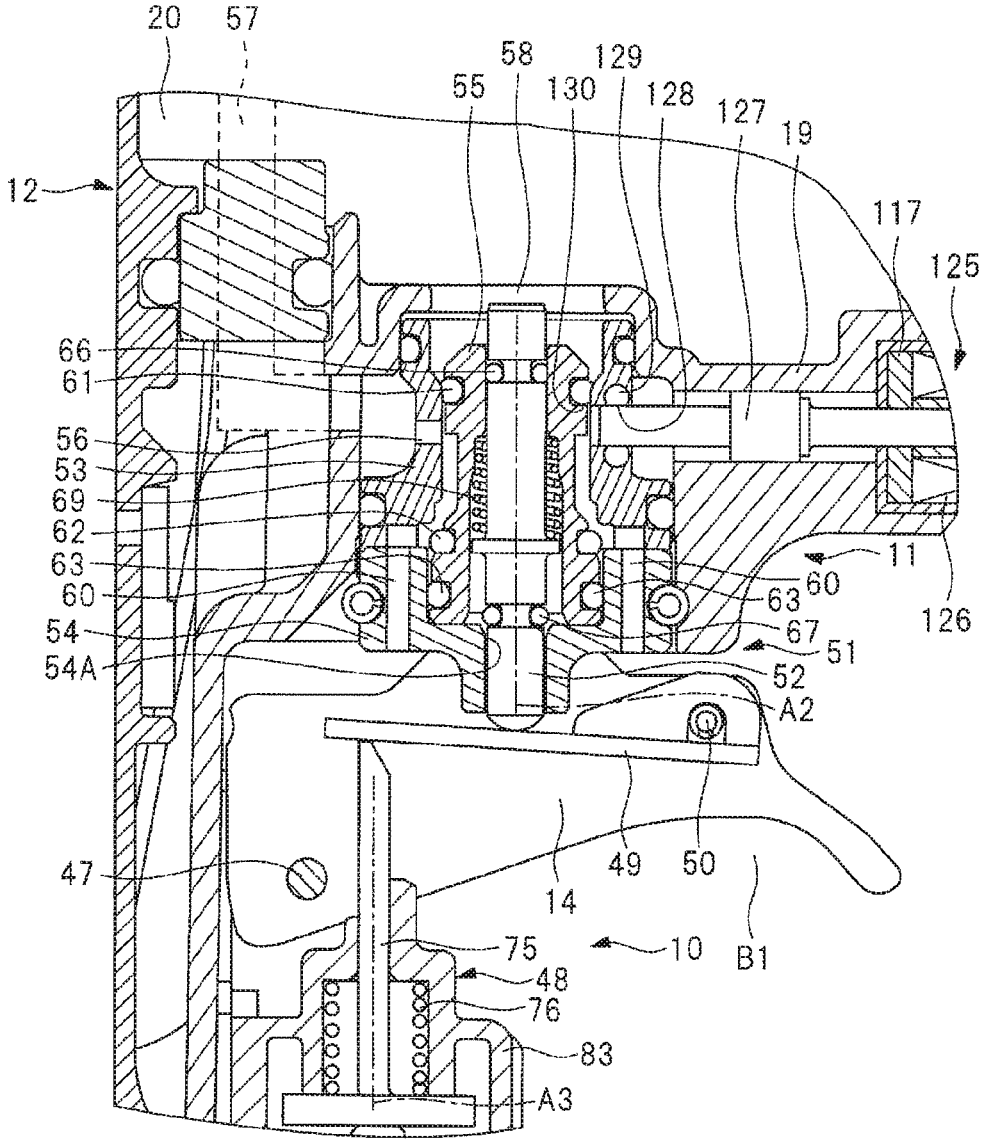
FIG. 17B is a cross-sectional view of the driver according to the fifth embodiment, showing the state where the trigger and the transmission member are at actuated positions and a plunger of a solenoid is stopped at an initial position.

When the supply of current to the solenoid 125 is stopped and the plunger 127 is stopped at the initial position shown in FIGS. 17A and 17B by the attractive force of the permanent magnet 117, the tip of the plunger 127 comes out of the inside of the first body 53 and is located in the shaft hole 128. Namely, the tip of the plunger 127 is located at the position outside the movement range of the engaging portion 130. Therefore, when the plunger 127 is stopped at the initial position, the plunger 127 does not contact the engaging portion 130 when the valve body 55 is actuated in the direction of the center line A2. Namely, the plunger 127 does not block the actuation of the valve body 55.

Figure 17C:
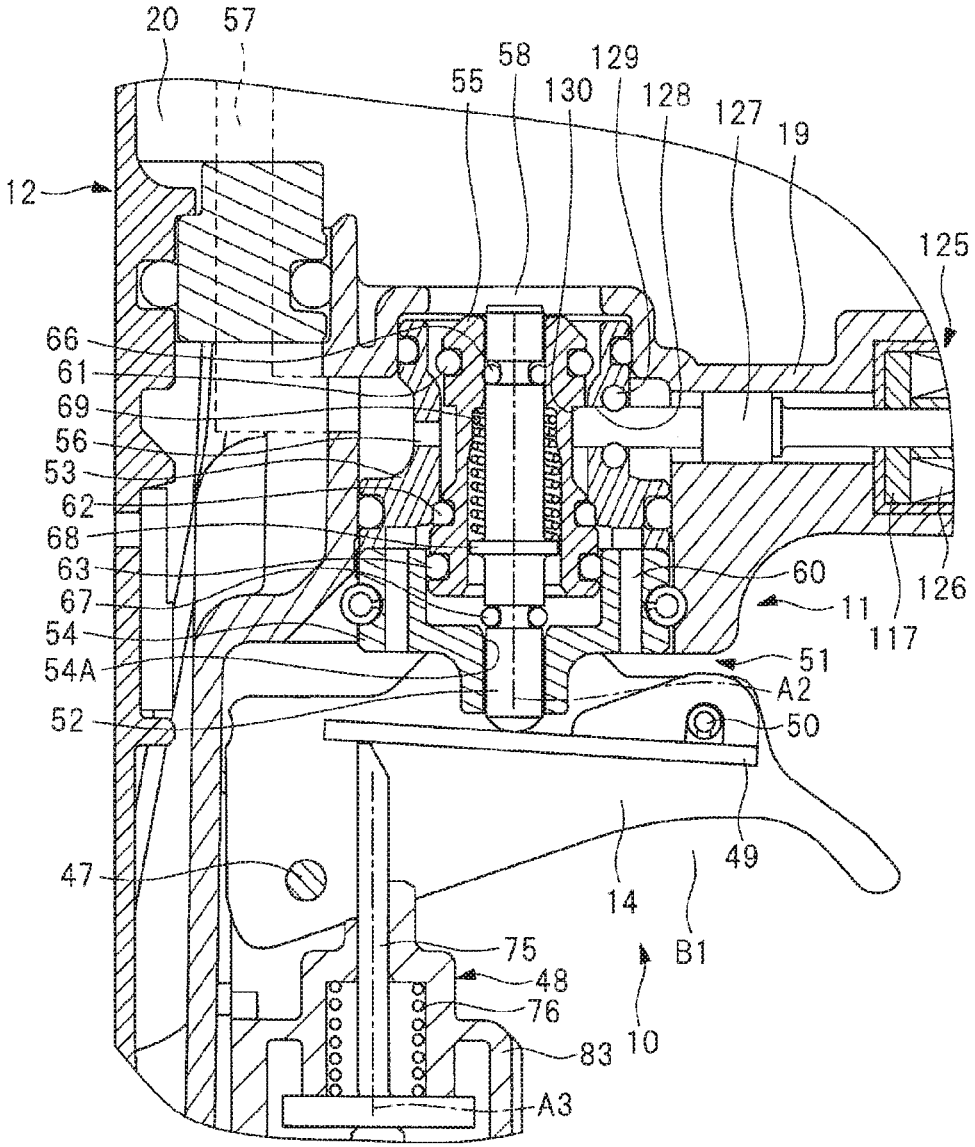
FIG. 17C is a cross-sectional view of the driver according to the fifth embodiment, showing the state where the trigger and the transmission member are at the actuated positions and the plunger of the solenoid is stopped at an actuated position.

When the supply of current to the solenoid 125 is stopped and the plunger 127 is stopped at the actuated position shown in FIG. 17C by the attractive force of the permanent magnet 117, the tip of the plunger 127 is located inside the first body 53. Namely, the tip of the plunger 127 is within the movement range of the engaging portion 130. Therefore, when the valve body 55 is actuated toward the arm 49 in the direction of the center line A2, the plunger 127 engages with the engaging portion 130. Namely, the plunger 127 blocks the actuation of the valve body 55. When the plunger 127 blocks the actuation of the valve body 55, the pressure accumulation chamber 20 and the passage 56 are connected, and the passage 56 and the passage 60 are disconnected.

The power switch 91 in the driver 10 according to the fifth embodiment only has a function of outputting a signal for detecting the position of the mode selection member 84, and does not have a function of connecting and disconnecting the electric circuit 138. Namely, regardless of whether the single firing mode or the continuous firing mode is selected, the power of the battery 96 is supplied to the controller 94 and the controller 94 is activated.

The driver 10 according to the fifth embodiment can perform the flowchart of FIG. 16. In step S22, the controller 94 supplies power to the solenoid 125 to actuate the plunger 127, and then stops the power supply to the solenoid 125. The plunger 127 is stopped at the actuated position shown in FIG. 17C.

In step S24, the controller 94 supplies power to the solenoid 125 to actuate the plunger 127, and then stops the power supply to the solenoid 125. The plunger 127 is stopped at the initial position shown in FIG. 17A. When the push lever 16 is pressed to the workpiece 77 after step S24 and the transmission member 75 is actuated, the actuation force of the transmission member 75 is transmitted to the plunger 52 through the arm 49 as shown in FIG. 17B. When the plunger 52 moves from the initial position to the actuated position and is stopped there, the valve body 55 moves from the initial position to the actuated position and is stopped there, and the sealing member 61 disconnects the pressure accumulation chamber 20 and the passage 56 and the passage 56 and the passage 60 are connected. Thus, the striking portion 13 drives the nail 73 in step S28.

When the controller 94 determines Yes in step S30, it supplies power to the solenoid 125 to actuate the plunger 127, and then stops the power supply to the solenoid 125 in step S31. The plunger 127 is stopped at the actuated position shown in FIG. 17C. When the plunger 127 is stopped at the actuated position shown in FIG. 17C, even if the push lever 16 is pressed to the workpiece 77 and the plunger 52 moves from the initial position to the actuated position, the plunger 127 blocks the actuation of the valve body 55. Namely, the pressure accumulation chamber 20 and the passage 56 are connected, the passage 56 and the passage 60 are disconnected, and the striking portion 13 is stopped at the top dead center as shown in FIG. 3A.

The controller 94 supplies power to the solenoid 125 to actuate the plunger 127, and then stops the power supply to the solenoid 125 in step S32. The plunger 127 is stopped at the initial position. By the process of step S32, the driver 10 can perform the single firing. When the single firing is selected, the actuation of the trigger 14, the actuation of the transmission member 75, the actuation of the arm 49, and the actuation of the plunger 52 are the same as those in the driver 10 according to the first embodiment.

The other processes and determinations in each step when performing the control example of FIG. 16 in the driver 10 according to the fifth embodiment are the same as the processes and determinations in each step when performing the control example of FIG. 16 in the driver 10 according to the fourth embodiment.

As described above, the controller 94 stops the supply of current to the solenoid 125 for at least part of the period of time from when the trigger switch 92 is turned on and the timer 98 is started to when the predetermined time elapses. Therefore, the driver 10 according to the fifth embodiment can obtain the same effect as that of the driver 10 according to the first embodiment.

Sixth Embodiment

A driver according to the sixth embodiment will be described with reference to FIGS. 18A and 18B. In the driver 10 according to the sixth embodiment, the same components as those of the driver 10 according to the first embodiment are designated by the same reference characters as those of the driver 10 according to the first embodiment. The trigger 14 can rotate about the support shaft 47 and can revolve about the boss portions 47A. Note that the biasing member 86 shown in FIGS. 5A and 5B is not provided, and the solenoid 87 shown in FIGS. 6A and 6B is not provided. Only when the worker operates the mode selection member 84, the mode selection member 84 can be switched between the first operation position and the second operation position. Further, the driver 10 has the trigger valve 51 shown in FIGS. 1 and 4A.

A solenoid 131 is provided in the ejection portion 15. The solenoid 131 is a keep solenoid having a coil 132, a plunger 133, and a ring-shaped permanent magnet 134. The plunger 133 is made of, for example, a magnetic material such as iron or steel.

When a current flows through the coil 132 in the solenoid 131, the plunger 133 is actuated in the axial direction against the attractive force of the permanent magnet 134. When the controller 94 switches the direction of the current supplied to the coil 132, the direction in which the plunger 133 is actuated can be changed.

When the controller 94 shuts off the power supply to the coil 132, the plunger 133 is stopped at a predetermined axial position by the attractive force of the permanent magnet 134. The plunger 133 is stopped at either the initial position shown in FIG. 18A or the actuated position shown in FIG. 18B.

An arm 136 that transmits the actuation force of the push lever 16 to the transmission member 75 is provided. The arm 136 has an engaging portion 137. The arm 136 moves together with the push lever 16 in the direction of the center line A1.

The driver 10 according to the sixth embodiment has the control system shown in FIG. 7. The power switch 91 in the driver 10 according to the sixth embodiment only has a function of outputting a signal for detecting the position of the mode selection member 84, and does not have a function of connecting and disconnecting the electric circuit 138. Namely, regardless of whether the single firing mode or the continuous firing mode is selected, the power of the battery 96 is supplied to the controller 94 and the controller 94 is activated.

The solenoid 131 corresponds to the actuator 112 shown in FIG. 7. The controller 94 can control supply and stop of current to the solenoid 131. Further, the controller 94 can switch the direction in which the current is supplied to the solenoid 131. The plunger 133 is actuated in the forward direction and the reverse direction in accordance with the direction in which the current is supplied to the solenoid 131.

Figure 18A:
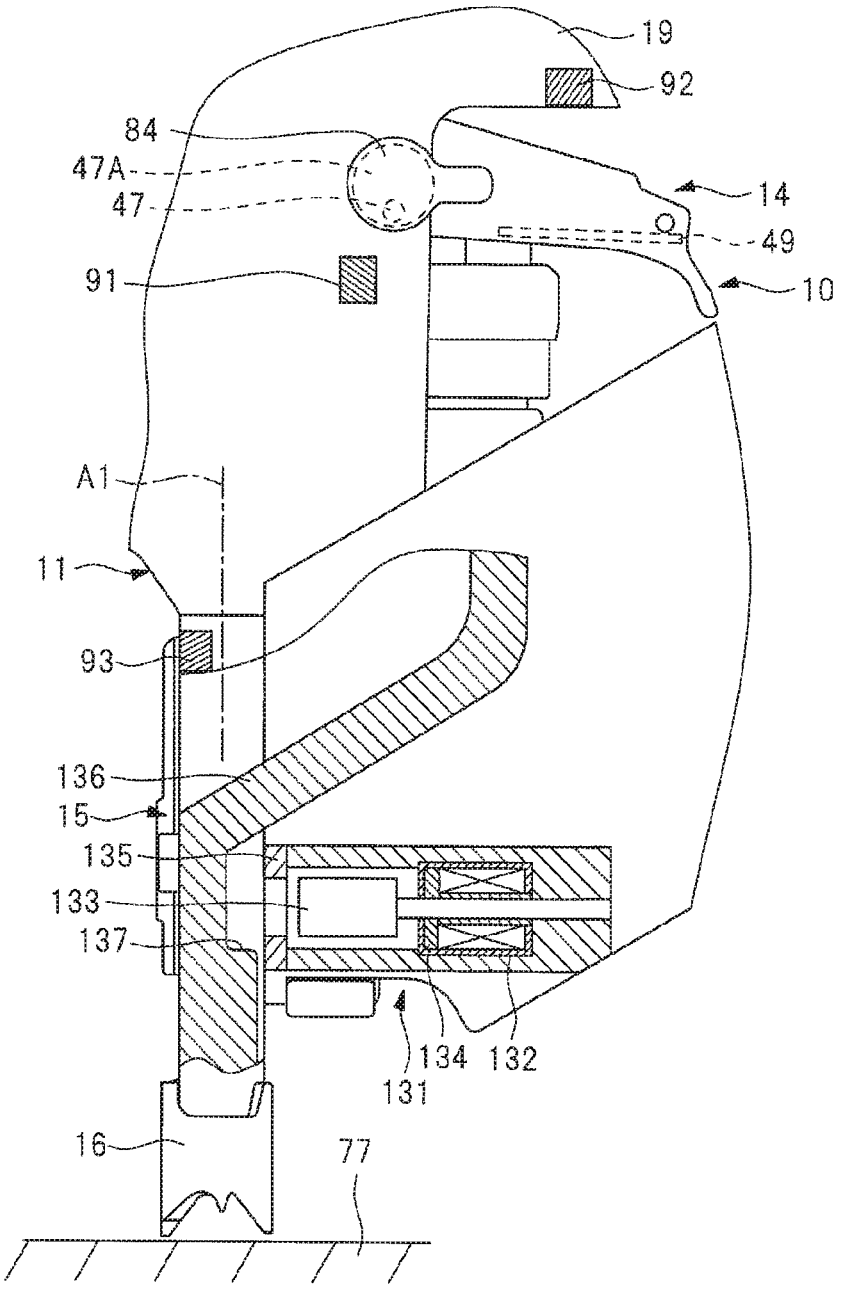
FIG. 18A is a cross-sectional view of a driver according to the sixth embodiment, showing the state where a plunger of a solenoid is stopped at an initial position.
Figure 18B:
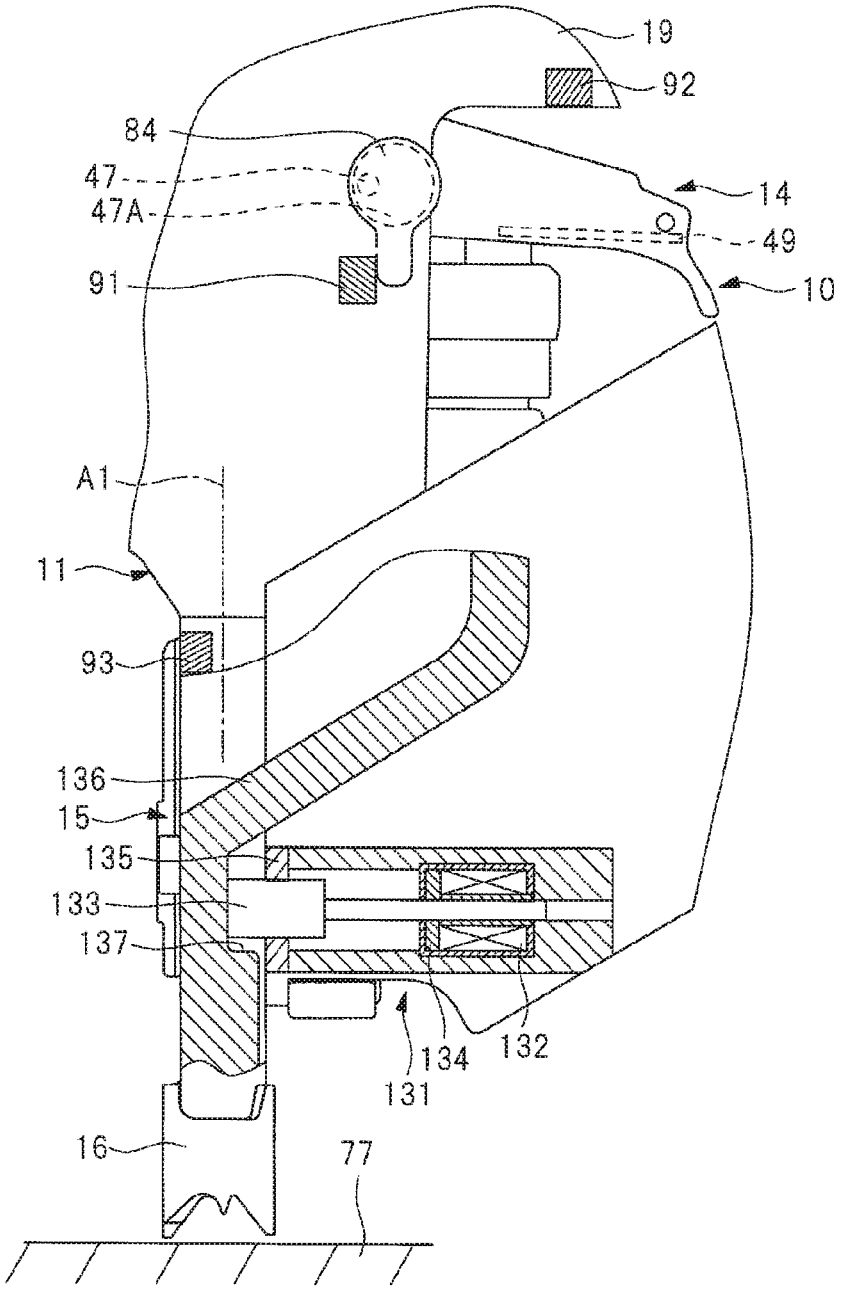
FIG. 18B is a cross-sectional view of the driver according to the sixth embodiment, showing the state where the plunger of the solenoid is stopped at an actuated position.

When the supply of current to the solenoid 131 is stopped, the plunger 133 is stopped at the initial position shown in FIG. 18A or the actuated position shown in FIG. 18B by the attractive force of the permanent magnet 134. When the plunger 133 is stopped at the initial position, the tip of the plunger 133 is located at the position outside the actuation range of the arm 136. Therefore, when the arm 136 is to be actuated in the direction of the center line A1, the actuation of the arm 136 is not blocked by the plunger 133. When the plunger 133 is stopped at the actuated position, the tip of the plunger 133 is located within the actuation range of the arm 136. Therefore, when the arm 136 is to be actuated in the direction of the center line A1, the actuation of the arm 136 is blocked by the plunger 133.

Also, in the state where the push lever 16 is separated from the workpiece 77, the shortest distance between the engaging portion 137 and the plunger 133 in the direction of the center line A1 is larger than the effective movement distance of the arm 136. The effective movement distance of the arm 136 corresponds to the amount of movement of the arm 136 in the direction of the center line A1 during the time from when the push lever switch 93 is turned off to when the push lever switch 93 is turned on.

The driver 10 according to the sixth embodiment can perform the flowchart of FIG. 16. In step S22, the controller 94 supplies power to the solenoid 131 to move the plunger 133 to the actuated position shown in FIG. 18B, and then stops the power supply to the solenoid 131. The plunger 133 is stopped at the actuated position by the attractive force of the permanent magnet 134.

In step S24, the controller 94 supplies power to the solenoid 131 to activate the plunger 133, and then stops the power supply to the solenoid 131. The plunger 133 is stopped at the initial position shown in FIG. 18A. When the push lever 16 is pressed to the workpiece 77 after step S24, the actuation of the arm 136 is not blocked by the plunger 133. Therefore, as shown in FIG. 4C, the plunger 52 of the trigger valve 51 is stopped at the actuated position, and the striking portion 13 drives the nail 73 in step S28.

When the controller 94 determines Yes in step S30, it supplies power to the solenoid 131 to actuate the plunger 133 and stops the power supply to the solenoid 131 in step S31. The plunger 133 is stopped at the actuated position shown in FIG. 18B. When the plunger 133 of the solenoid 131 is stopped at the actuated position shown in FIG. 18B, the actuation of the arm 136 is blocked by the plunger 133 even if the push lever 16 is pressed to the workpiece 77. Therefore, as shown in FIG. 4B, the plunger 52 of the trigger valve 51 is stopped at the initial position, the pressure accumulation chamber 20 and the passage 56 are connected, and the passage 56 and the passage 60 are disconnected. Therefore, the striking portion 13 is stopped at the top dead center as shown in FIG. 3A.

In step S32, the controller 94 stops the plunger 133 of the solenoid 131 at the initial position as shown in FIG. 18A, and stops the power supply to the solenoid 131. By the process of step S32, the driver 10 can perform the single firing. When the single firing is selected, the actuation of the trigger 14, the actuation of the transmission member 75, the actuation of the arm 49, and the actuation of the plunger 52 are the same as those in the driver 10 according to the first embodiment.

The other processes and determinations in each step when performing the control example of FIG. 16 in the driver 10 according to the sixth embodiment are the same as the processes and determinations in each step when performing the control example of FIG. 16 in the driver 10 according to the fourth embodiment.

As described above, the controller 94 stops the supply of current to the solenoid 131 for at least part of the period of time from when the trigger switch 92 is turned on and the timer 98 is started in step S23 to when the predetermined time elapses. Therefore, the driver 10 according to the sixth embodiment can obtain the same effect as that of the driver 10 according to the first embodiment.

An example of the correspondence relationship between the matters disclosed in the embodiments and the matters described in the claims is as follows. The driver 10 is an example of a driver. The upper piston chamber 36 is an example of a pressure chamber. The striking portion 13 is an example of a striking portion. The direction in which the striking portion 13 is actuated from the top dead center to the bottom dead center is an example of "a direction in which the striking portion strikes a fastener". The direction in which the striking portion 13 is actuated along the center line A1 in the direction away from the stopper 29 is an example of "a direction in which the striking portion strikes a fastener". The trigger 14 is an example of a first operation member. The push lever 16 is an example of a second operation member.

Applying the operation force to the trigger 14 by the worker is an example of "applying an operation force to the first operation member". Releasing the operation force applied to the trigger 14 by the worker is an example of "releasing the operation force of the first operation member". Pressing the push lever 16 to the workpiece 77 by the worker is an example of "applying an operation force to the second operation member". Separating the push lever 16 from the workpiece 77 by the worker is an example of "releasing the operation force of the second operation member".

The actuated position of the solenoid 87 in the first and second embodiments is an example of the first control state, and the initial position of the solenoid 87 is an example of the second control state. The actuated position of the servo motor 109 in the third embodiment is an example of the first control state, and the initial position of the servo motor 109 is an example of the second control state. The initial position of the solenoid 113 in the fourth embodiment is an example of the first control state, and the actuated position of the solenoid 113 is an example of the second control state.

The initial position of the solenoid 125 in the fifth embodiment is an example of the first control state, and the actuated position of the solenoid 125 is an example of the second control state. The initial position of the solenoid 131 in the sixth embodiment is an example of the first control state, and the actuated position of the solenoid 131 is an example of the second control state.

The solenoids 87, 113, 125, 131, and the servo motor 109 are examples of a switching mechanism. The controller 94 and the switch circuit 97 are examples of a control unit. The pressure accumulation chamber 20 is an example of a pressure accumulation chamber. The trigger valve 51 is an example of a gas supply mechanism. The actuated state of the trigger valve 51 is an example of a strikable state. The initial state of the trigger valve 51 is an example of an unstrikable state.

The transmission member 75 and the plunger 52 are examples of a first path and a second path. The state where the actuation force of the transmission member 75 can be transmitted to the plunger 52 is an example of "connecting the first path" and "connecting the second path". The state where the actuation force of the transmission member 75 cannot be transmitted to the plunger 52 is an example of "disconnecting the first path" and "disconnecting the second path".

The port 33 is an example of a first passage, and the passages 56, 57, and 60 are examples of a second passage. The control chamber 27 is an example of a control chamber. The head valve 31 is an example of an opening/closing mechanism. The solenoid 113 is an example of a valve or a solenoid valve. Locating the solenoid 113 of the fourth embodiment at the initial position is an example of "a first actuated state of the valve". Locating the solenoid 113 of the fourth embodiment at the actuated position is an example of "a second actuated state of the valve". The solenoids 87, 113, 125, and 131 are examples of a solenoid, and the servo motor 109 is an example of a servo motor. Stopping the power supply to each of the solenoids 87, 113, 125, and 131 is an example of the first control or the second control. Stopping the power supply to the servo motor 109 is an example of the first control or the second control. The power switch 91 is an example of a power supply mechanism.

The state where the operation force to the trigger 14 and the push lever 16 is released can be defined as a first operation state. The state where the operation force to the trigger 14 is released and the operation force to the push lever 16 is applied can be defined as a second operation state. The operation of applying the operation force to the push lever 16 and then applying the operation force to the trigger 14 can be defined as a third operation state. The state where the operation force is applied to the trigger 14 and the push lever 16 is separated from the workpiece 77 can be defined as a fourth operation state. The state where the operation force is applied to the trigger 14 and the push lever 16 can be defined as a fifth operation state.

In the continuous firing, when the operation force is applied to the trigger 14 and then the operation force is applied to the push lever 16, the trigger valve 51 is switched from the initial position to the actuated position, and the striking portion 13 is actuated in the direction of striking the fastener 73. On the other hand, in the single firing, when the operation force is applied to the trigger 14 and then the operation force is applied to the push lever 16, the trigger valve 51 is held at the initial position. Namely, the striking portion 13 is not actuated in the direction of striking the fastener 73, and the striking portion 13 is stopped at the top dead center.

The driver is not limited to the above-mentioned embodiments, and various modifications can be made without departing from the gist of the invention. For example, the first operation member includes an element which is linearly actuated within a predetermined range by the application of the operation force other than an element which rotates within a range of a predetermined angle by the application of the operation force. The first operation member includes a lever, a knob, a button, an arm, and the like. The second operation member is an element that is pressed to the workpiece and is linearly actuated, and the second operation member may be not only a member provided independently of an ejection port of the ejection portion but also a member provided integrally with the ejection port. The ejection port is formed at the end of the ejection portion. Also, the members constituting the second operation member include a lever, an arm, a rod, a plunger, and the like. Further, the second operation member may have a tubular shape at a portion in contact with the workpiece or have a plate-like shape through the whole in the direction of the center line A1.

The control unit may be a single electric component or a single electronic component, or a unit having a plurality of electric components or a plurality of electronic components. The electric component or the electronic component includes a processor, a control circuit, and a module. The gas supply mechanism includes a switching valve that switches between the connection of the passages and the disconnection of the passages from each other. The first passage and the second passage include a port, a hole formed in a member, a space formed in a member, a gap between members, and an opening formed in a member. The control chamber is a space formed by members. The opening/closing mechanism includes a valve body that is actuated by the pressure of the compressed gas. Further, the timing of starting the counting of the predetermined time may be set to the time when the continuous firing is selected other than the time when the trigger switch 92 is turned on.

As the compressed gas, inert gas such as nitrogen gas or rare gas may be used instead of the compressed air. The striking portion may have either a structure in which the piston and the driver blade are integrally formed or a structure in which the piston and the driver blade that are separately provided are fixed to each other. The fastener includes a nail having a shaft portion and a head portion as well as a nail having a shaft portion and no head portion. The fastener includes a U-shaped pin, a U-shaped screw, and the like. The fastener includes an arbitrary shape and structure that are inserted into the workpiece and fixed to the workpiece. The switching mechanism is an actuator that is actuated by the supply of power. Actuating the striking portion in the direction of striking the fastener does not matter whether the striking portion strikes the fastener.

The keep solenoid may have a return spring in addition to the coil and the permanent magnet. The keep solenoid is just required to have a structure in which the plunger is stopped at a predetermined position when no power is supplied.

In addition, in the single firing, the striking portion 13 is actuated in the direction of striking the nail 73 by putting the driver 10 into the third operation state in which the operation force is applied to the push lever 16 and then the operation force is applied to the trigger 14. The single firing includes drag firing. The drag firing is a usage mode in which after moving down the striking portion 13 by pressing the push lever 16 to the workpiece 77, the push lever 16 is slid and stopped on the workpiece 77 while keeping the second operation state in which the operation force to the trigger 14 is released and the operation force to the push lever 16 is applied, and then the striking portion 13 is moved down by applying the operation force to the trigger 14 again.

Also, the continuous firing corresponds to the operation in which the state where the operation force to either the trigger 14 or the push lever 16 is released is changed to the state where the operation force is applied to the trigger 14 and the push lever 16. Therefore, although not specifically disclosed, the continuous firing includes the operation in which the state where the operation force is applied to the push lever 16 and the operation force to the trigger 14 is released is changed to the state where the operation force is applied to the trigger 14 and the push lever 16.

Further, the single firing and the continuous firing are defined by the order and state of applying and releasing the operation force to the trigger 14 and the push lever 16. The single firing and the continuous firing are not distinguished by the time interval when the striking portion is actuated in the direction of striking the fastener. The single firing and the continuous firing are not distinguished by the number of times the striking portion is actuated in the direction of striking the fastener within a predetermined time. It is also possible to define the single firing as the first usage mode and the continuous firing as the second usage mode.

REFERENCE SIGNS LIST

10 . . . driver, 13 . . . striking portion, 14 . . . trigger, 16 . . . push lever, 20 . . . pressure accumulation chamber, 27 . . . control chamber, 31 . . . head valve, 33 . . . port, 36 . . . upper piston chamber, 51 . . . trigger valve, 52 . . . plunger, 56, 57, 60 . . . passage, 75 . . . transmission member, 87, 113, 125, 131 . . . solenoid, 91 . . . power switch, 94 . . . controller, 97 . . . switch circuit, 109 . . . servo motor

The invention claimed is:

1. A driver comprising:

a pressure chamber;

a striking portion actuated in a direction of striking a fastener when compressed gas is supplied to the pressure chamber; and a first operation member and a second operation member configured to control the striking of the fastener, wherein the driver is configured to select a single firing in which the striking portion is actuated in the direction of striking the fastener when an operation force is applied to the first operation member while an operation force is applied to the second operation member and a continuous firing in which the striking portion is actuated in the direction of striking the fastener when the operation force is applied to the second operation member while the operation force is applied to the first operation member, wherein the driver further comprises:

a switching mechanism having a first control state in which the striking portion is actuatable in the direction of striking the fastener and a second control state in which the striking portion is blocked from being actuated in the direction of striking the fastener; and a control unit configured to switch a state of the switching mechanism between the first control state and the second control state, wherein the control unit controls supplying power to the switching mechanism when switching the state of the switching mechanism between the first control state and the second control state, and the switching mechanism maintains the first control state or the second control state even when the power supplied to the switching mechanism is stopped, and wherein the control unit performs a first control in which, when the continuous firing is selected, the power is supplied to the switching mechanism to change the state of the switching mechanism from the second control state to the first control state and then the power supplied to the switching mechanism is stopped, and a second control in which, when a predetermined time elapses in a state where the continuous firing is selected and the switching mechanism is in the first control state, the power is supplied to the switching mechanism to change the state of the switching mechanism from the first control state to the second control state and then the power supplied to the switching mechanism is stopped.

2. The driver according to claim 1, wherein the control unit stops the power supplied to the switching mechanism for at least part of a period of time when a predetermined time elapses.

3. The driver according to claim 1, further comprising:

a pressure accumulation chamber configured to store the compressed gas; and a gas supply mechanism configured to supply the compressed gas of the pressure accumulation chamber to the pressure chamber, wherein the gas supply mechanism has a strikable state in which, when the operation force is applied to the first operation member and the second operation member, the compressed gas of the pressure accumulation chamber is supplied to the pressure chamber and an unstrikable state in which, when the operation force to at least one of the first operation member and the second operation member is released, the compressed gas of the pressure accumulation chamber is not supplied to the pressure chamber.

4. The driver according to claim 3, wherein the switching mechanism is configured to connect or disconnect a first path for transmitting the operation force applied to the first operation member and the second operation member to the gas supply mechanism, the first control state of the switching mechanism is a state of connecting the first path, and the second control state of the switching mechanism is a state of disconnecting the first path.

5. The driver according to claim 3, further comprising:

a first passage configured to supply the compressed gas of the pressure accumulation chamber to the pressure chamber;

a control chamber to which the compressed gas of the pressure accumulation chamber is supplied and from which it is exhausted;

a second passage configured to supply and exhaust the compressed gas to and from the control chamber; and an opening/closing mechanism configured to close the first passage when the compressed gas is supplied to the control chamber and open the first passage when the compressed gas is exhausted from the control chamber, wherein the switching mechanism includes a valve configured to open and close the second passage, the first control state of the switching mechanism is a state in which the valve opens the second passage when the compressed gas is supplied to the control chamber, and the second control state of the switching mechanism is a state in which the valve closes the second passage when the compressed gas is supplied to the control chamber.

6. The driver according to claim 3, further comprising a second path to transmit the operation force applied to the second operation member to the first operation member, wherein the operation force applied to the second operation member is transmitted to the gas supply mechanism through the first operation member, the switching mechanism can connect and disconnect the second path, the first control state of the switching mechanism is a state of disconnecting the second path, and the second control state of the switching mechanism is a state of connecting the second path.

7. The driver according to claim 1, wherein the control unit is activated when power is supplied and is stopped when power is not supplied, and the driver further comprising a power supply mechanism configured to stop the power supply to the control unit when the single firing is selected and supply the power to the control unit when the continuous firing is selected.

8. The driver according to claim 1, wherein the control unit is activated when power is supplied and is stopped when power is not supplied, and the driver further comprising a power supply mechanism configured to supply the power to the control unit even when any of the single firing and the continuous firing is selected.

9. The driver according to claim 1, wherein the switching mechanism includes a solenoid, a solenoid valve, or a servo motor.

10. The driver according to claim 1, wherein the solenoid or the solenoid valve includes:

a plunger actuated in a predetermined direction when power is supplied; and a permanent magnet configured to stop the plunger at a predetermined position in an actuation direction when the power is not supplied.

11. The driver according to claim 1, wherein the single firing restricts the striking portion from being actuated in the direction of striking the fastener when the operation force is applied to the first operation member and then the operation force is applied to the second operation member.

12. A driver comprising:

a pressure chamber;

a pressure accumulation chamber configured to store compressed gas; and a gas supply mechanism configured to supply the compressed gas of the pressure accumulation chamber to the pressure chamber, a striking portion actuated in a direction of striking a fastener when the compressed gas is supplied to the pressure chamber;

a first operation member and a second operation member configured to control the gas supply mechanism to supply the compressed gas to the pressure chamber;

a switching mechanism including a movable part having a first position to transmit operation force applied to the first operation member and the second operation member to the gas supply mechanism, and a second position not to transmit the operation force applied to the first operation member and the second operation member to the gas supply mechanism; and a control unit configured to control supplying power to the switching mechanism, wherein the control unit switches the movable part between the first position and the second position by supplying the power to the switching mechanism, and wherein the switching mechanism maintains the movable part at the first position or the second position even when the power supplied to the switching mechanism is stopped.

13. A driver comprising:

a pressure chamber;

a pressure accumulation chamber configured to store compressed gas; and a gas supply mechanism configured to supply the compressed gas of the pressure accumulation chamber to the pressure chamber, a striking portion actuated in a direction of striking a fastener when compressed gas is supplied to the pressure chamber; and a first operation member and a second operation member configured to control the gas supply mechanism to supply the compressed gas to the pressure chamber;

a switching mechanism including a plunger and a permanent magnet; and a control unit configured to control supplying power to the switching mechanism, wherein the control unit switches the plunger between a first position in which the striking portion is actuatable in the direction of striking the fastener and a second position in which the striking portion is blocked from being actuated in the direction of striking the fastener by supplying the power to the switching mechanism, and wherein the switching mechanism maintains the plunger at the first position or the second position by attractive force of the permanent magnet even when the power supplied to the switching mechanism is stopped.

* * * * *